US010442196B2

(12) United States Patent
Kobayashi

(10) Patent No.: US 10,442,196 B2
(45) Date of Patent: Oct. 15, 2019

(54) CHANNEL MEMBER, LIQUID EJECTION HEAD, AND RECORDING APPARATUS

(71) Applicant: KYOCERA Corporation, Kyoto-shi, Kyoto (JP)

(72) Inventor: Naoki Kobayashi, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/738,030

(22) PCT Filed: Jun. 28, 2016

(86) PCT No.: PCT/JP2016/069070
§ 371 (c)(1),
(2) Date: Dec. 19, 2017

(87) PCT Pub. No.: WO2017/002778
PCT Pub. Date: Jan. 5, 2017

(65) Prior Publication Data

US 2018/0304631 A1 Oct. 25, 2018

(30) Foreign Application Priority Data

Jun. 29, 2015 (JP) ..... 2015-130005

(51) Int. Cl.
*B41J 2/14* (2006.01)
*B41J 2/045* (2006.01)

(52) U.S. Cl.
CPC ..... *B41J 2/14209* (2013.01); *B41J 2/04581* (2013.01); *B41J 2002/14217* (2013.01);
(Continued)

(58) Field of Classification Search
CPC ..... B41J 2/14209; B41J 2/04581; B41J 2002/14217; B41J 2002/14459; B41J 2002/14419; B41J 2002/14225
See application file for complete search history.

(56) References Cited

U.S. PATENT DOCUMENTS

2005/0116992 A1* 6/2005 Akahane ..... B41J 2/14274 347/54
2012/0236085 A1* 9/2012 Miyata ..... B41J 2/14233 347/71
2015/0138282 A1* 5/2015 Kobayashi ..... B41J 2/04543 347/70

FOREIGN PATENT DOCUMENTS

JP 2007-050671 A 3/2007
JP 2009-143168 A 7/2009
(Continued)

OTHER PUBLICATIONS

International Search Report, PCT/JP2016/069070, dated Sep. 13, 2016, 1 pg.

*Primary Examiner* — Yaovi M Ameh
(74) *Attorney, Agent, or Firm* — Volpe and Koenig, P.C.

(57) ABSTRACT

A channel member includes an integrating channel, a plurality of common channels, a plurality of individual channels, and a plurality of ejection ports. The integrating channel extends in a first direction. The plurality of common channels extends in a second direction, is spaced apart from each other in the first direction, and is individually connected to the integrating channel. The plurality of individual channels is connected to the respective plurality of common channels. Each of the plurality of ejection ports is linked with at least one corresponding individual channel. Each of the plurality of common channels includes a first connection region connected to the plurality of individual channels, and a second connection region connected to the integrating channel. Each of the plurality of common channels includes an opening in the second connection region linked with the integrating channel, and a damper in a portion facing the opening.

13 Claims, 9 Drawing Sheets

(52) U.S. Cl.
CPC ..... *B41J 2002/14225* (2013.01); *B41J 2002/14419* (2013.01); *B41J 2002/14459* (2013.01)

(56) References Cited

FOREIGN PATENT DOCUMENTS

| | | | |
|---|---|---|---|
| JP | 2012-011629 | A | 1/2012 |
| JP | 2015-006788 | A | 1/2015 |

* cited by examiner

CHANNEL MEMBER, LIQUID EJECTION HEAD, AND RECORDING APPARATUS

TECHNICAL FIELD

The present invention relates to a channel member, a liquid ejection head, and a recording apparatus.

BACKGROUND ART

Conventionally, as a printing head, for example there has been known a liquid ejection head performing various types of printing by ejecting liquid onto a recording medium. As such a liquid ejection head, for example there is known a liquid ejection head provided with ejection holes ejecting a liquid, pressurizing chambers pressurizing the liquid so that the liquid is ejected from the ejection holes, individual channels supplying the liquid to pressurizing chambers, common channels which supply the liquid to the plurality of individual channels, and an integrating channel which supplies the liquid to the plurality of common channels (for example, see Patent Literature 1).

CITATION LIST

Patent Literature

Patent Literature 1: Japanese Patent Publication No. 2012-11629A

SUMMARY OF INVENTION

A channel member according to the present disclosure includes an integrating channel, a plurality of common channels, a plurality of individual channels, and a plurality of ejection holes. The integrating channel extends in a first direction. The plurality of common channels extend in a direction crossing the first direction defined as a second direction, are arranged spaced apart from each other in the first direction, and are individually connected to the integrating channel. The plurality of individual channels are connected to the respective plurality of common channels. Each of the plurality of ejection holes is linked with at least one corresponding individual channel of the plurality of individual channels. Each of the plurality of common channels includes a region to which the plurality of individual channels are connected, constituting a first connection region, and a region connected to the integrating channel constituting a second connection region so that they are spaced apart from each other in the second direction. Each of the plurality of common channels includes an opening which is provided in the second connection region and is linked with the integrating channel, and a damper provided in a portion facing the opening in the second connection region.

DESCRIPTION OF EMBODIMENTS

In a conventional liquid ejection head, sometimes pressure fluctuation caused in the liquid in the integrating channel due to various causes was transferred through the common channels and individual channels to the liquid in the ejection holes and the transferred pressure fluctuation exerted an influence upon the ejection of the liquid. The channel member in the present disclosure can reduce transfer of pressure fluctuation caused in the liquid in the integrating channel to the liquid in the ejection holes. Below, the channel member, liquid ejection head, and recording apparatus of the present disclosure will be explained in detail.

First Embodiment

Figure 1A:
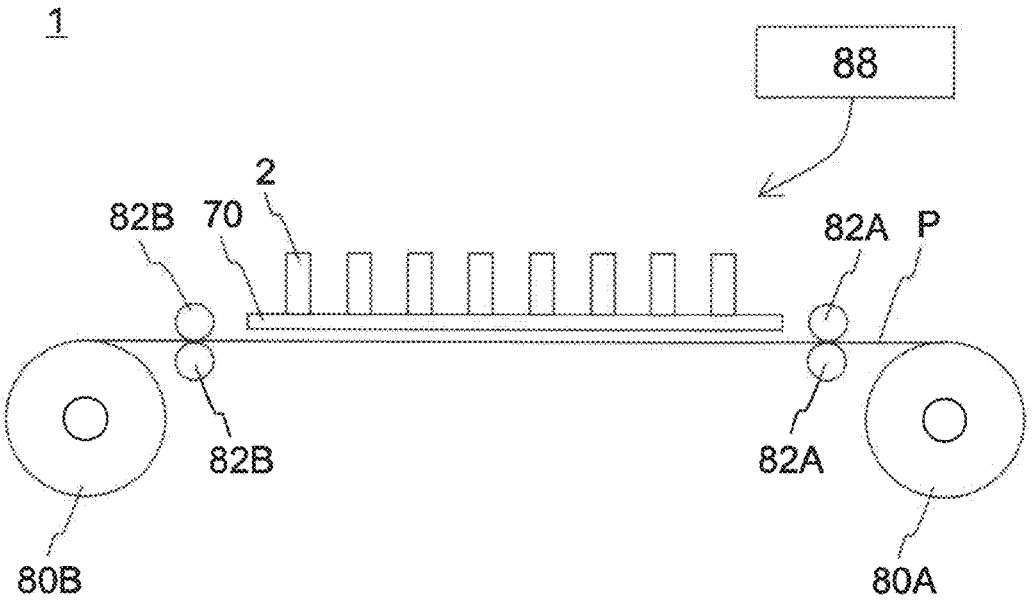
FIG. 1A is a side view of a recording apparatus including liquid ejection heads according to a first embodiment of the present invention.
Figure 1B:
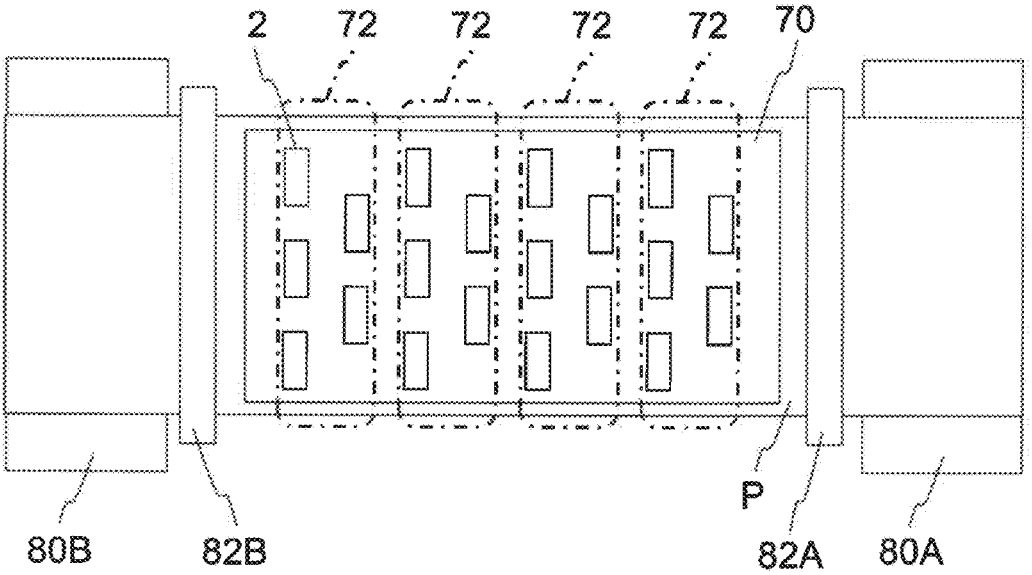
FIG. 1B is a plan view.

FIG. 1A is a schematic side view of a color inkjet printer 1 (below, sometimes simply referred to as a "printer") which is a recording apparatus including liquid ejection heads 2 according to a first embodiment of the present invention, and FIG. 1B is a schematic plan view. The printer 1 conveys a printing paper P which is a recording medium from a paper feed roller 80A to a collection roller 80B to make the printing paper P relatively move with respect to the liquid ejection heads 2. The control part 88 controls the liquid ejection heads 2 based on image or text data to make them eject the liquid toward the printing paper P and shoot droplets onto the printing paper P to thereby performing recording such as printing on the printing paper P.

In the present embodiment, the liquid ejection heads 2 are fixed with respect to the printer 1. That is, the printer 1 becomes a so-called line printer. As another embodiment of the recording apparatus of the present invention, there can be mentioned a so-called serial printer which alternately performs an operation of moving the liquid ejection heads 2 to reciprocate or the like in a direction crossing the conveying direction of the printing paper P, for example, a substantially perpendicular direction, and conveyance of the printing paper P.

To the printer 1, a plate-shaped head mounting frame 70 (below, sometimes simply referred to as a "frame") is fixed so that it becomes substantially parallel to the printing paper P. The frame 70 is provided with not shown 20 holes. Twenty liquid ejection heads 2 are mounted in the hole portions. The portions of the liquid ejection heads 2 which eject the liquid face the printing paper P. The distance between the liquid ejection heads 2 and the printing paper P is set to for example about 0.5 to 20 mm. Five liquid ejection heads 2 configure one head group 72. The printer 1 has four head groups 72.

A liquid ejection head 2 has a long shape elongated in a direction from the front to the inside in FIG. 1A and in the up-down direction in FIG. 1B. This long direction will be sometimes called the "longitudinal direction". In one head group 72, three liquid ejection heads 2 are aligned in a direction crossing the conveying direction of the printing paper P, for example, a substantially perpendicular direction. The other two liquid ejection heads 2 are aligned at positions offset along the conveying direction so that each is arranged between two among the three liquid ejection heads 2. The liquid ejection heads 2 are arranged so that ranges which can be printed by the liquid ejection heads 2 are connected in the width direction of the printing paper P (in the direction crossing the conveying direction of the printing paper P) or the ends overlap each other, therefore printing without a gap becomes possible in the width direction of the recording medium P.

The four head groups 72 are arranged along the conveying direction of the printing paper P. To each liquid ejection head 2, a liquid, for example, ink, is supplied from a not shown liquid tank. To the liquid ejection heads 2 belonging to one head group 72, ink of the same color is supplied. Inks of four colors can be printed by the four head groups 72. The colors of inks ejected from the head groups 72 are for example magenta (M), yellow (Y), cyan (C), and black (K). If printing such inks is carried out by controlling by the control part 88, color images can be printed.

The number of liquid ejection heads 2 mounted in the printer 1 may be one as well so far as printing is carried out for a range which can be printed by one liquid ejection head 2 in a single color. The number of liquid ejection heads 2 included in the head group 72 or the number of head groups 72 can be suitably changed according to the target of printing or printing conditions. For example, the number of head groups 72 may be increased as well in order to perform printing by further multiple colors. Further, if a plurality of head groups 72 for printing in the same color are arranged and printing is alternately carried out in the conveying direction, the conveying speed can be made faster even if liquid ejection heads 2 having the same performances are used. Due to this, the printing area per time can be made larger. Further, it is also possible to raise the resolution in the width direction of the printing paper P by preparing a plurality of head groups 2 for printing in the same color and arranging them offset in a direction crossing the conveying direction.

Further, other than printing colored inks, a coating agent or other liquid may be printed as well in order to treat the surface of the printing paper P.

The printer 1 performs printing on the printing paper P which is the recording medium. The printing paper P is wound around the paper feed roller 80A. After passing between the two guide rollers 82A, it passes under the liquid ejection heads 2 mounted in the frame 70. After that, it passes between the two conveying rollers 82B and is finally collected by the collection roller 80B. When printing, by rotation of the conveying rollers 82B, the printing paper P is conveyed at a constant speed, and printing is carried out by the liquid ejection heads 2. The collection roller 80B takes up the printing paper P fed out from the conveying rollers 82B. The conveying speed is set to for example 50 m/min. Each roller may be controlled by the control part 88 or may be operated manually by a person.

The recording medium may be a roll of fabric or the like other than printing paper P. Further, the printer 1, in place of directly conveying the printing paper P, may directly convey a conveyor belt and put the recording medium on the conveyor belt to convey it. When performing this, a sheet, cut fabric, wood, tile, etc. can be used as the recording medium. Further, a liquid containing conductive particles may be ejected from the liquid ejection heads 2 to print a wiring pattern etc. of an electronic apparatus as well. Furthermore, predetermined amounts of liquid chemical agents or liquids containing chemical agents may be ejected from the liquid ejection heads 2 toward a reaction vessel or the like to cause a reaction etc. and thereby prepare pharmaceutical products.

Further, a position sensor, speed sensor, temperature sensor, and the like may be attached to the printer 1, and the control part 88 may control the portions in the printer 1 in accordance with the states of the portions in the printer 1 seen from the information from the sensors. For example, when the temperature of the liquid ejection heads 2 or temperature of the liquid in the liquid tank, the pressure applied by the liquid in the liquid tank to the liquid ejection heads 2, and so on exert an influence upon the ejection characteristics (ejection amount, ejection speed, etc.) of the ejected liquid, a driving signal for ejecting the liquid may be changed in accordance with that information as well.

Figure 2A:
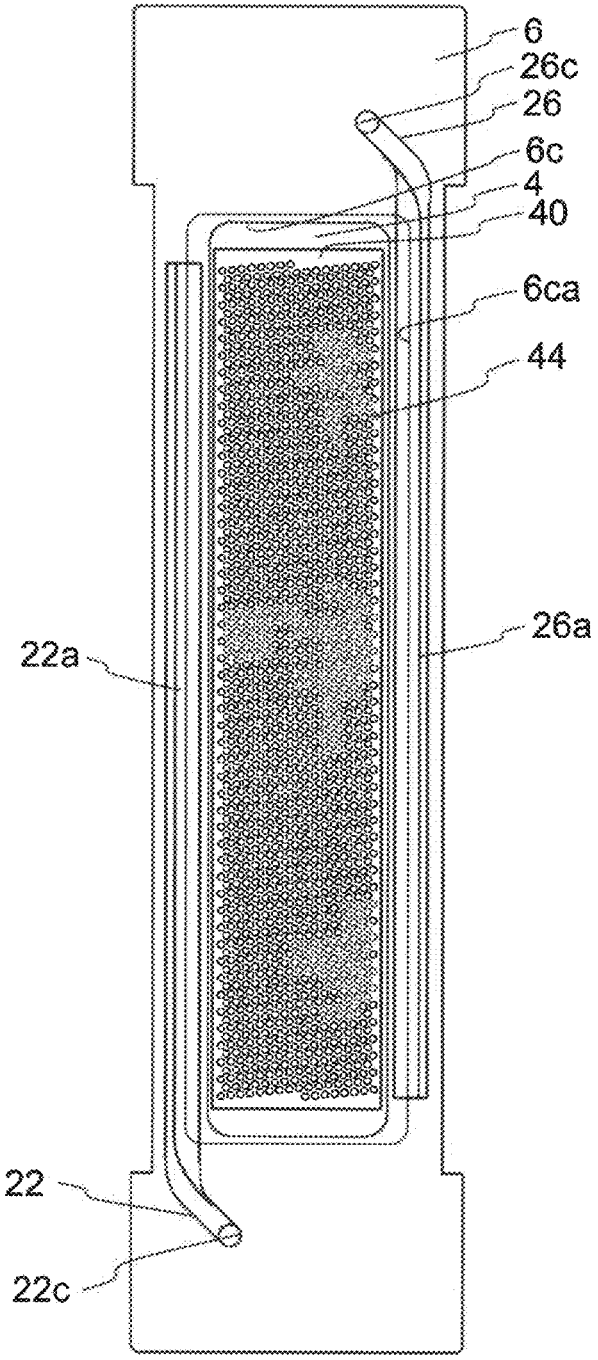
FIG. 2A is a plan view of a principal part of a liquid ejection head in FIGS. 1A and 1B, that is, a head body.
Figure 2B:
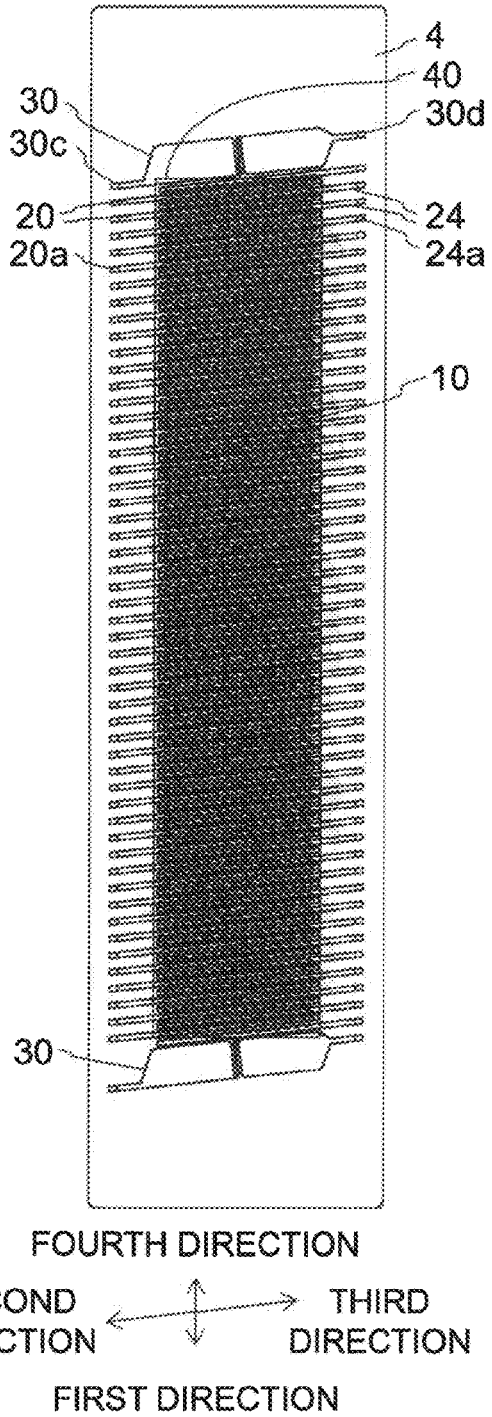
FIG. 2B is a plan view excluding a second channel member from FIG. 2A.
Figure 3:
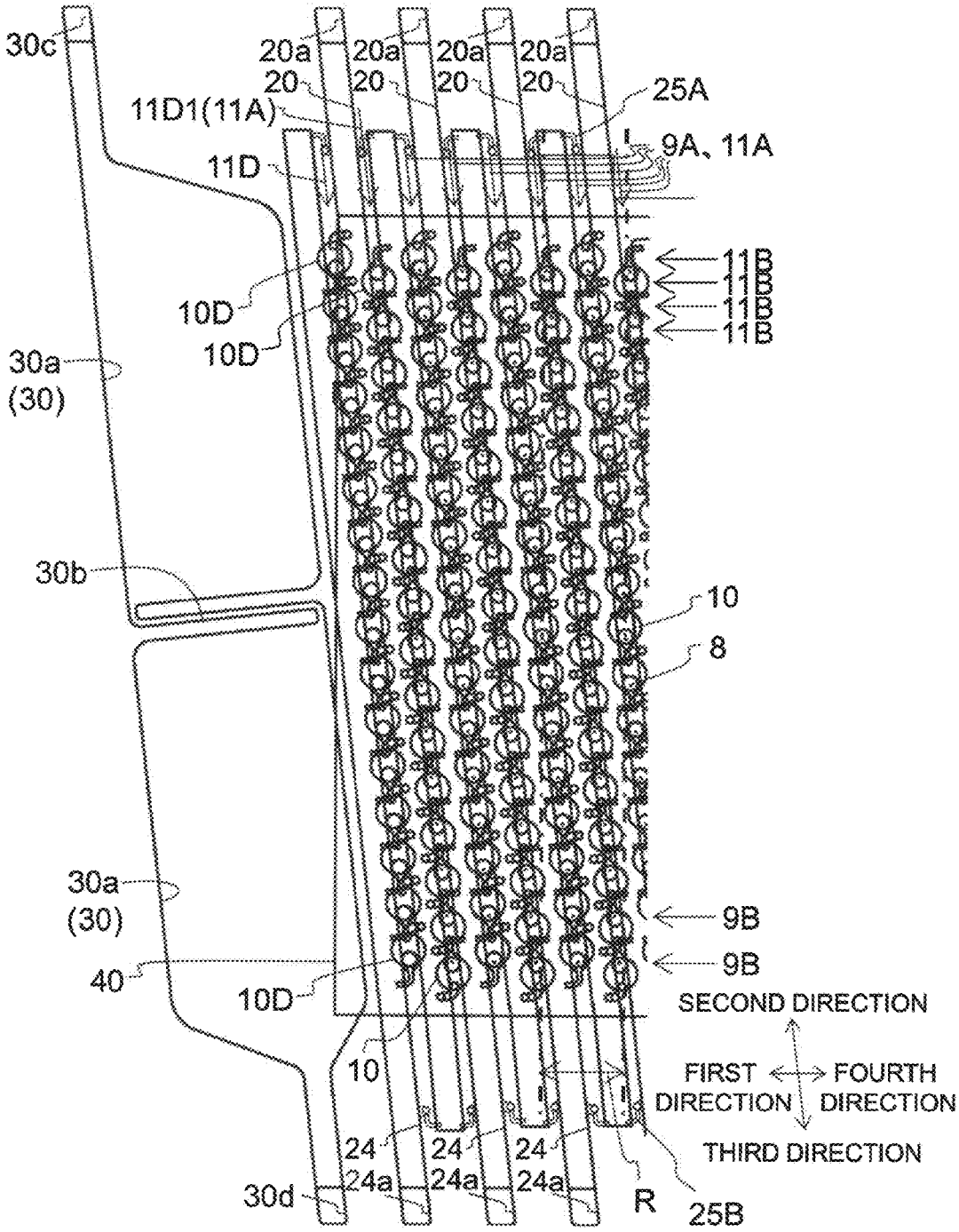
FIG. 3 An enlarged plan view of a portion in FIG. 2B.
Figure 4:
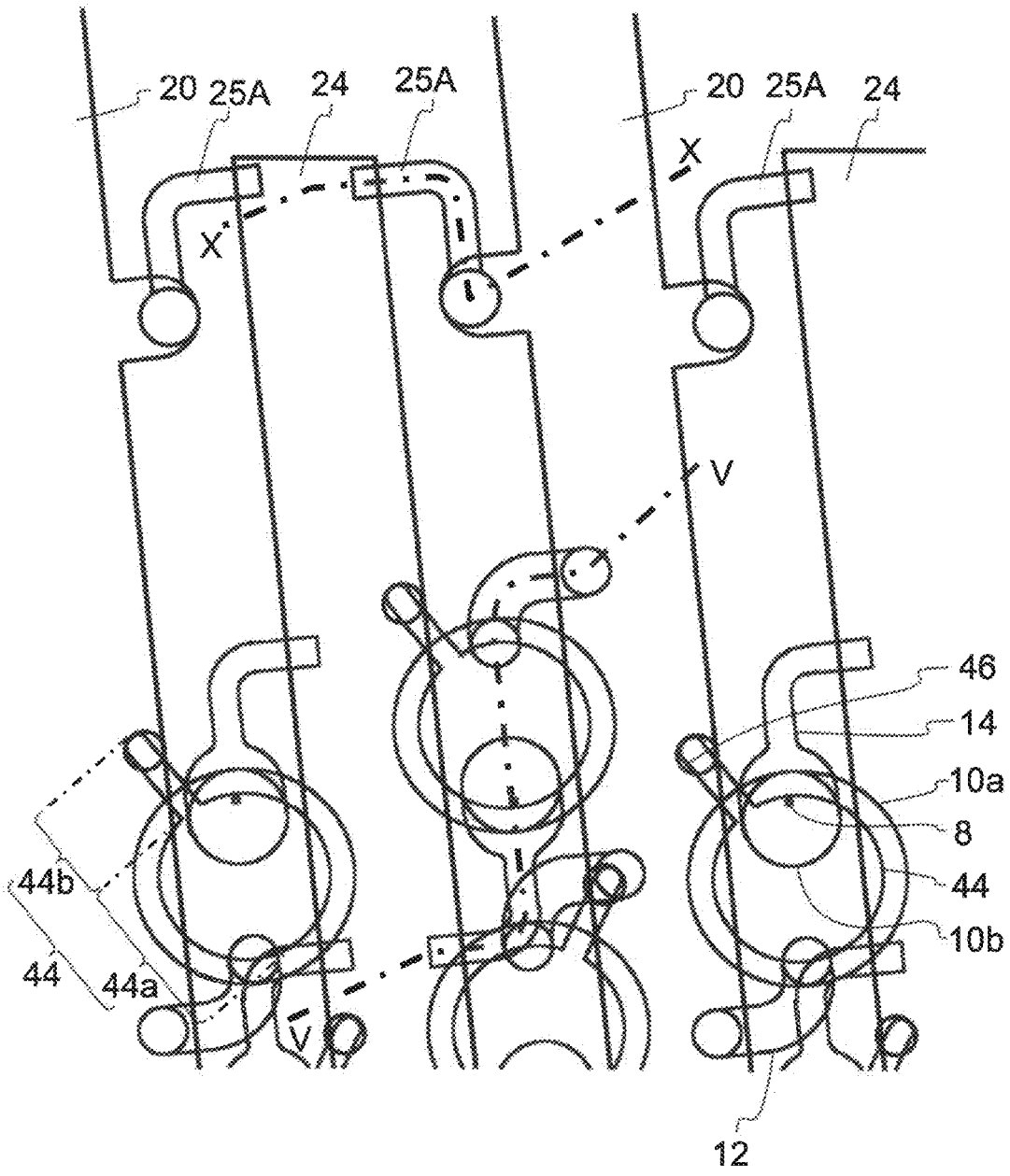
FIG. 4 An enlarged plan view of a portion in FIG. 2B.
Figure 5A:
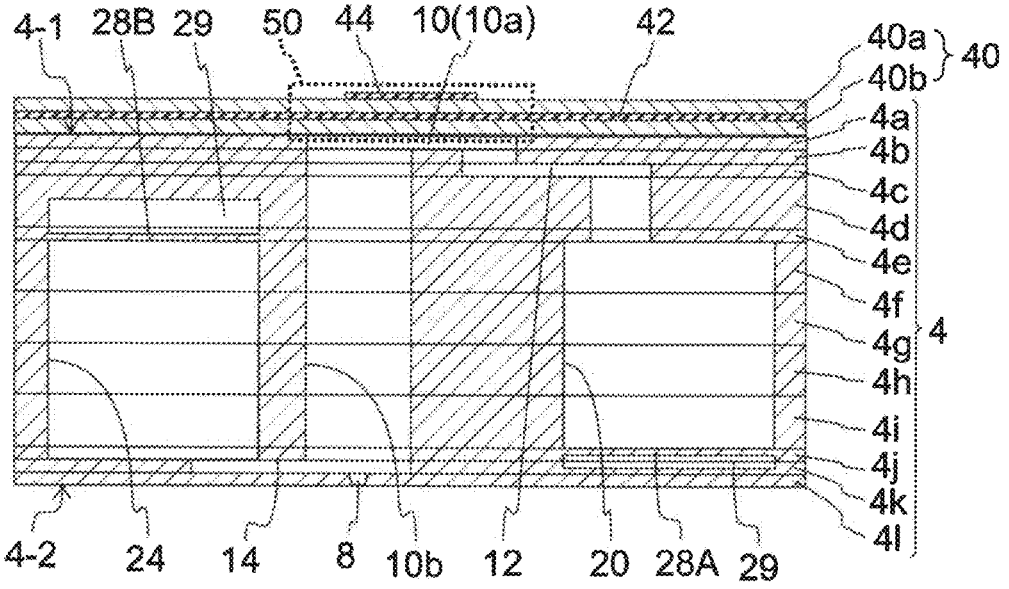
FIG. 5A is a partial vertical cross-sectional view along the V-V line in FIG. 4.
Figure 5B:
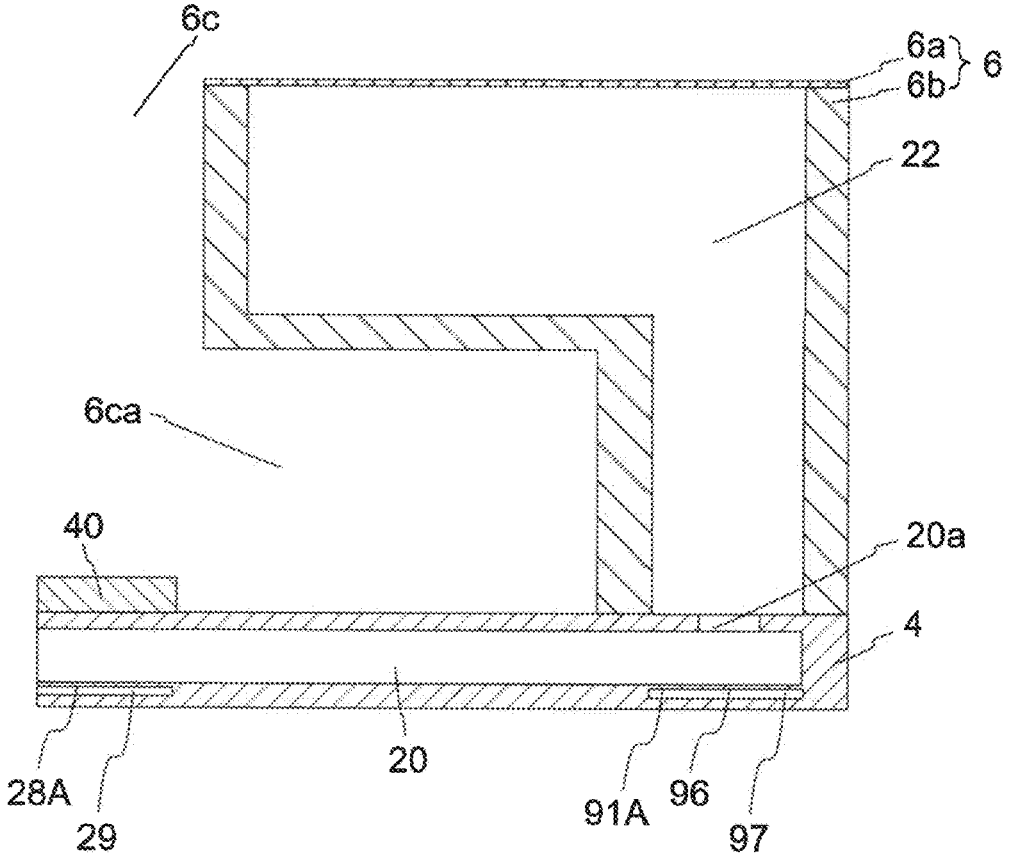
FIG. 5B is a partial vertical cross-sectional view of the head body in FIG. 2A.
Figure 6:
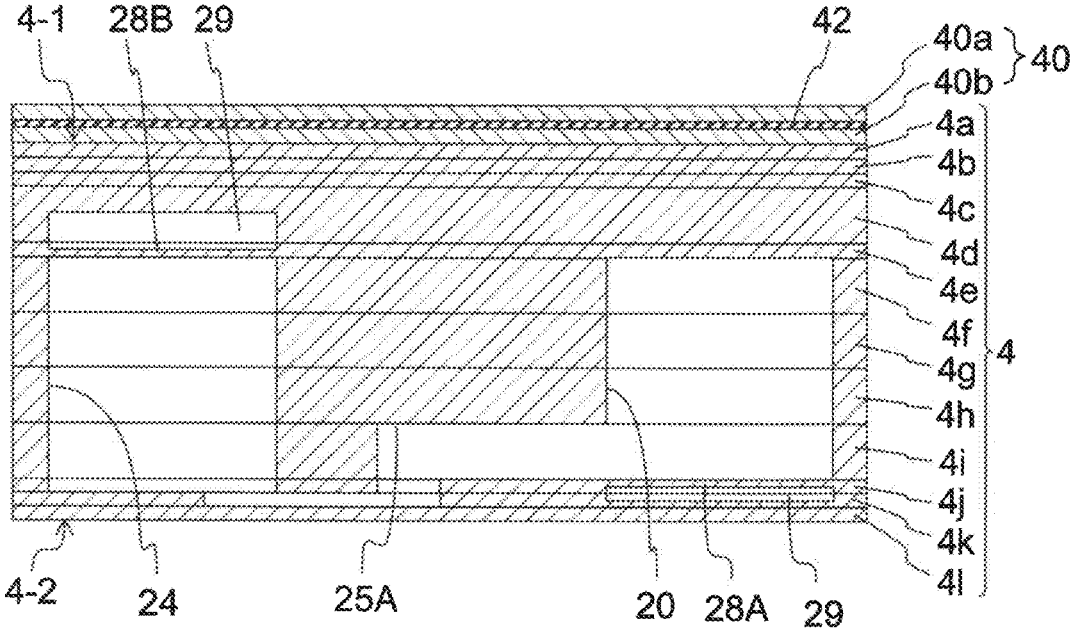
FIG. 6 A partial vertical cross-sectional view along the X-X line in FIG. 4.

Next, a liquid ejection head 2 in the first embodiment of the present invention will be explained. FIG. 2A is a plan view showing a head body 2*a* forming a principal part of a liquid ejection head 2 shown in FIGS. 1A and 1B. FIG. 2B is a plan view showing a state after excluding the second channel member 6 from the head body 2*a*. FIG. 3 and FIG. 4 are enlarged plan views of FIG. 2B. FIG. 5A is a vertical cross-sectional view along the V-V line in FIG. 4. FIG. 5B is a partial vertical cross-sectional view along a first common channel 20 in the vicinity of an opening 20*a* in the first common channel 20 in the head body 2*a*. FIG. 6 is a partial vertical cross-sectional view along the X-X line in FIG. 4.

The drawings are drawn in the following way in order to facilitate understanding of the drawings. In FIGS. 2A and 2B to 4, channels etc. which are located beneath others and should be drawn by broken lines are drawn by solid lines. In FIG. 2A, most of the channels in the first channel member 4 are omitted. Only the arrangement of individual electrodes 44 is shown. Further, in FIGS. 2A and 2B and FIG. 3, a first common channel 20 and a second common channel (collection-use common channel) 24 are drawn while simplifying their shapes.

The liquid ejection head 2, other than the head body 2*a*, may include a housing made of metal, a driver IC, a circuit board, etc. as well. Further, the head body 2*a* includes a first channel member 4, a second channel member 6 which supplies liquid to the first channel member 4, and a piezoelectric actuator substrate 40 in which displacement elements 50 as pressurizing portions are assembled. The head body 2*a* has a plate shape which is long in one direction. That direction will be sometimes referred to as the "longitudinal direction". Further, the second channel member 6 plays the role of a support member. The head body 2*a* is fixed at the two end parts in the longitudinal direction of the second channel member 6 to the frame 70.

The first channel member 4 configuring the head body 2*a* has a plate shape. Its thickness is about 0.5 to 2 mm. On the first surface of the first channel member 4, that is, the pressurizing chamber surface 4-1, a large number of pressurizing chambers 10 are arranged aligned in the surface direction. On the second surface of the first channel member 4 on the opposite side to the pressurizing chamber surface 4-1, that is, the ejection hole surface 4-2, a large number of ejection holes 8 ejecting liquid are arranged aligned in the surface direction. The ejection holes 8 are individually linked with the pressurizing chambers 10. Below, the explanation will be given assuming that the pressurizing chamber surface 4-1 is positioned above relative to the ejection hole surface 4-2.

In the first channel member 4, a plurality of first common channels 20 and a plurality of second common channels 24 are arranged so as to extend along the second direction. Further, the first common channels 20 and the second common channels 24 are alternately aligned in the direction crossing the second direction, that is, the first direction. The plurality of first common channels 20 are arranged spaced apart from each other in the first direction, while the plurality of second common channels 24 are arranged spaced apart from each other in the first direction. Note that, the first direction is the same direction as the longitudinal direction of the head body 2*a*.

The pressurizing chambers 10 are aligned along the two sides of each of the first common channels 20 and configure one column on each side, i.e., two pressurizing chamber columns 11A in total. Each first common channel 20 and the pressurizing chambers 10 which are aligned on the two sides thereof are linked through first individual channels 12. Each of the pressurizing chambers 10 is connected to at least one first individual channel 12 and is supplied with liquid from the connected first individual channel 12. Further, each of the ejection holes 8 is provided corresponding to a pressurizing chamber 10 and is connected to the corresponding pressurizing chamber 10. The ejection hole 8 is connected through the pressurizing chamber 10 to at least one corresponding first individual channel 12.

The pressurizing chambers 10 are aligned along the two sides of each of the second common channels 24 and configure one column on each side, i.e., two pressurizing chamber columns 11A in total. Each second common channel 24 and the pressurizing chambers 10 which are aligned on the two sides thereof are linked through second individual channels (collection-use individual channels) 14. Note that, below, sometimes the first common channels 20 and the second common channels 24 will be referred to together as the "common channels".

Expressed another way, the pressurizing chambers 10 are arranged on imaginary lines. On one side of each imaginary line, a first common channel 20 extends along the imaginary line. Further, on the other side of the imaginary line (the opposite side to the side for positioning the first common channel 20 across the imaginary line), a second common channel 24 extends along the imaginary line. Note that, in the present embodiment, the imaginary lines on which the pressurizing chambers 10 are aligned are straight lines, but may be curved lines or bent lines as well.

Further, each first common channel 20 and second common channel 24 are linked through a first connection channel 25A and second connection channel 25B (the two will be sometimes simply referred to together as the "connection channels") outside of the range where the pressurizing chambers 10 are connected in the second direction. To the first common channel 20, a plurality of first individual channels 12 are connected in a certain range in the second direction. This is connected through the plurality of first individual channels 12 to the plurality of pressurizing chambers 10. That range will be called the "first connection region C". The first common channel 20, outside of the first connection region C in the second direction, is linked through one first connection channel 25A with each of the second common channels 24 which are neighboring in the first direction. Further, outside of the first connection region C in the third direction (direction opposite to the second direction), the first common channel 20 is linked through the second connection channel 25B with each of the second common channels 24 which are neighboring in the first direction. That is, at the first common channel 20, two first connection channels 25A are linked outside of the first connection region C in the second direction, and two second connection channels 25B are linked outside of the first connection region C in the third direction, i.e., four connection channels in total are linked.

By the configuration as described above, the flow of the liquid in the first channel member 4 becomes as follows. The liquid supplied to the first common channels 20 flows into the pressurizing chambers 10 which are aligned along the first common channels 20. Part of the liquid is ejected from the ejection holes 8. The other part of the liquid flows into the second common channels 24 which are positioned on the opposite sides to the first common channels 20 relative to the pressurizing chambers 10 and is discharged to the outside of the first channel member 4. Further, part of the liquid does not pass through any pressurizing chambers 10 and flows from the first common channels 20 through the first connection channels 25A and second connection channels 25B into the second common channels 24.

The channel resistances of the connection channels become larger than those of the first common channels 20 and second common channels 24. For this reason, the main flow of liquid becomes a flow passing through the pressurizing chambers 10. That is, in the flow through the parts having the largest flow rate in the first common channels 20, the total of the flow of the liquid which passes through the connection channels is half or less. By doing this, the difference of pressures applied to the menisci of the ejection holes 8 (below, sometimes simply referred to as the "pressure difference of menisci") can be made smaller.

In the present embodiment, second common channels 24 are arranged on the two sides of each first common channel 20 and first common channels 20 are arranged on the two sides of each second common channel 24. Due to this, each pressurizing chamber column 11A has one first common channel 20 and one second common channel 24 linked with it. Due to this, compared with a case where a different pressurizing chamber column 11A has another first common channel 20 and another second common channel 24 linked with it, the number of first common channels 20 and second common channels 24 can be almost halved. Since the number of the first common channels 20 and second common channels 24 may be made smaller, the number of pressurizing chambers 10 can be increased to achieve a higher resolution, the first common channels 20 and second common channels 24 can be widened to make the difference of ejection characteristics from the ejection holes 8 smaller, and the size of the head body 2*a* in the surface direction can be made smaller.

In a first individual channel 12 which is linked with a first common channel 20, the pressure which is applied to the portion on the first common channel 20 side changes according to the position of linkage of the first individual channel 12 with the first common channel 20 (mainly the position in the second direction) due to the influence of pressure loss. In a second individual channel 14 which is linked with a second common channel 24, the pressure applied to the portion on the second common channel 24 side changes according to the position of linkage of the second individual channel 14 with the second common channel 24 (mainly the position in the second direction) due to the influence of pressure loss. If the openings 20*a* of the first common channels 20 to the outside are arranged at the end parts in the second direction and the openings 24*a* of the second common channels 24 to the outside are arranged at the end parts in the third direction, they act so as to cancel out the difference of pressures due to the arrangement of the first individual channels 12 and the second individual channels 14, therefore the difference of pressures applied to the ejection holes 8 can be made smaller. Note that, both of the openings 20*a* in the first common channels 20 and the openings 24*a* in the second common channels 24 open at the pressurizing chamber surface 4-1.

In a state where the liquid is not ejected, the menisci of the liquid are kept in the ejection holes 8. By the pressure of the liquid becoming a negative pressure in the ejection holes 8 (state of trying to draw liquid into the first channel member 4), the menisci can be retained by balance with the surface tension of the liquid. The surface tension of the liquid tries to make the surface area of the liquid smaller. Therefore, even if a positive pressure, if the pressure is small, the menisci can be held. If the positive pressure becomes larger, the liquid overflows. If the negative pressure becomes larger, the liquid ends up being drawn into the first channel member 4, therefore a liquid ejectable state cannot be maintained. For this reason, it is necessary to prevent the pressure difference of the menisci from increasing too much when the liquid flows from the second common channel 24 to the first common channel 20.

The wall surface of a first common channel 20 on the ejection hole surface 4-2 side forms a first damper 28A. The first surface of the first damper 28A faces the first common channel 20, while the second surface positioned on the opposite side to the first surface faces a damper chamber 29. Due to existence of the damper chamber 29, the first damper 28A becomes deformable. By deformation, the volume of the first common channel 20 can be changed. When the liquid in the pressurizing chamber 10 is pressurized in order to eject the liquid, a portion of that pressure is transferred through the liquid to the first common channel 20. Due to this, the liquid in the first common channel 20 vibrates. That vibration is sometimes transferred to the original pressurizing chamber 10 or other pressurizing chamber 10, whereupon fluid crosstalk is generated causing fluctuation of ejection characteristics of the liquid. If there is the first damper 28A, the first damper 28A vibrates by the vibration of the liquid transferred to the first common channel 20, and the vibration of the liquid attenuates. Due to this, it becomes harder to sustain the vibration of the liquid in the common channel 20, therefore the influence of fluid crosstalk can be made smaller. Further, the first damper 28A performs the role of stabilizing supply and discharge of the liquid as well.

The wall surface of a second common channel 24 on the pressurizing chamber surface 4-1 side forms a second damper 28B. The first surface of the second damper 28B faces the second common channel 24, while the second surface positioned on the opposite side to the first surface faces the damper chamber 29. The second damper 28B can reduce the influence of fluid crosstalk in the same way as the first damper 28A. Further, the second damper 28B performs the role of stabilizing the supply and discharge of the liquid as well.

A pressurizing chamber 10 is a hollow region including a pressurizing chamber body 10*a* arranged so as to face the pressurizing chamber surface 4-1 and receiving pressure from the displacement element 50, and a descender 10*b* which is a partial channel linked from the bottom of the pressurizing chamber body 10*a* to the ejection hole 8 opened in the ejection hole surface 4-2. The pressurizing chamber body 10*a* is a right circular cylinder shape and has a circular planar shape. Due to its circular planar shape, the amount of displacement where the displacement element 50 causes deformation with the same power and the change of volume of the pressurizing chamber 10 caused by displacement can be made larger. The descender 10*b* has a right circular cylinder shape smaller in diameter than the pressurizing chamber body 10*a* and is circular in cross-sectional shape. Further, when viewed from the pressurizing chamber surface 4-1, the descender 10*b* is arranged at the position within the pressurizing chamber body 10*a*.

The plurality of pressurizing chambers 10 are arranged in a staggered state on the pressurizing chamber surface 4-1. The plurality of pressurizing chambers 10 configure the plurality of pressurizing chamber columns 11A along the second direction. In each pressurizing chamber column 11A, the pressurizing chambers 10 are arranged at substantially equal intervals. The pressurizing chambers 10 belonging to the adjoining pressurizing chamber columns 11A are arranged offset in the second direction by about half of the interval described above. Expressed otherwise, each pressurizing chamber 10 belonging to a certain pressurizing chamber column 11A is positioned at substantially the center in the second direction between two successive pressurizing chambers 10 which belong to the pressurizing chamber column 11A which is positioned adjacent to the former.

Due to this, the pressurizing chambers 10 belonging to every other of the pressurizing chamber columns 11A end up being arranged along the first direction and configure a pressurizing chamber row 11B.

In the present embodiment, there are 51 first common channels 20 and 50 second common channels 24, so there are 100 pressurizing chamber columns 11A. Note that, here, dummy pressurizing chamber columns 11D configured by only dummy pressurizing chambers 10D which will be explained later are not included in the number of the pressurizing chamber columns 11A explained above. Further, second common channels 24 to which only the dummy pressurizing chambers 10D are directly linked are not included in the number of the second common channels 24 explained above. Further, 16 pressurizing chambers 10 are included in each pressurizing chamber column 11A. However, the pressurizing chamber column 11A positioned on the end in the first direction includes eight pressurizing chambers 10 and eight dummy pressurizing chambers 10D. As explained above, the pressurizing chambers 10 are arranged in a staggered state, therefore there are 32 pressurizing chamber rows 11B.

The plurality of pressurizing chambers 10 are arranged on the ejection hole surface 4-2 in a lattice shape along the second direction and first direction. The plurality of ejection holes 8 configure a plurality of ejection hole columns 9A along the second direction. The ejection hole columns 9A and the pressurizing chamber columns 11A are arranged at substantially the same positions.

The centers of gravity of areas of the pressurizing chambers 10 and the ejection holes 8 linked with the pressurizing chambers 10 are arranged offset in the second direction. In one pressurizing chamber column 11A, the direction of offset is the same. Between adjoining pressurizing chamber columns 11A, the directions of offset become inverse. Due to this, the ejection holes 8 linked with the pressurizing chambers 10 belonging to two pressurizing chamber rows 11B configure one ejection hole row 9B arranged along the first direction.

Accordingly, in the present embodiment, there are 100 ejection hole columns 9A and 16 ejection hole rows 9B.

The centers of gravity of areas of the pressurizing chamber bodies 10*a* and the ejection holes 8 linked from the pressurizing chamber bodies 10*a* are offset in positions in substantially the second direction. The descenders 10*b* are arranged at positions offset in the direction of the ejection holes 8 relative to the pressurizing chamber bodies 10*a*. The side walls of the pressurizing chamber bodies 10*a* and the side walls of the descenders 10*b* are arranged so as to be contiguous. Due to this, it is possible to make it difficult for liquid to pool in the pressurizing chamber bodies 10*a*.

The ejection holes 8 are arranged at the central parts of the descenders 10*b*. Here, a "central part" means a region inside a circle centered about the center of gravity of area of the descender 10*b* and of half of the diameter of the descender 10*b*.

The second individual channels 14 are led out from the surfaces of the descenders 10*b* on the ejection hole surface 4-2 sides to the surface direction and are linked with the second common channels 24. The led out direction is the same as the direction in which the descenders 10*b* are offset relative to the pressurizing chamber bodies 10*a*.

The angle formed by the second direction and the first direction is off from a right angle. For this reason, the ejection holes 8 belonging to the ejection hole columns 9A which are arranged along the second direction are arranged offset in the first direction by the amount of the angle off from the right angle. Further, the ejection hole columns 9A are arranged aligned in the first direction, therefore the ejection holes 8 belonging to the different ejection hole columns 9A are arranged offset in the first direction by that amount. By combining them, the ejection holes 8 in the first channel member 4 are aligned at constant intervals in the first direction. Due to this, printing can be carried out so as to fill a predetermined range with pixels formed by the ejected liquid.

If the ejection holes 8 belonging to one ejection hole column 9A are arranged on a completely straight line along the second direction, printing is possible so as to fill the predetermined range as explained above. However, when they are arranged in that way, the effect of the deviation between the direction perpendicular to the first direction and the conveying direction which occurs when setting the liquid ejection heads 2 in the printer 1 upon the printing precision becomes larger. For this reason, preferably the ejection holes 8 are replaced and arranged between the adjoining ejection hole columns 9A from the arrangement of the ejection holes 8 on a straight line as explained above.

In the present embodiment, the arrangement of the ejection holes 8 becomes as follows. In FIG. 3, when projecting the ejection holes 8 in the direction perpendicular to the first direction, 32 ejection holes 8 are projected in a range of the imaginary line R, therefore the ejection holes 8 are aligned at intervals of 360 dpi in the imaginary line R. Due to this, if the printing paper P is conveyed in the direction perpendicular to the imaginary line R to perform printing, printing can be carried out with a resolution of 360 dpi. The ejection holes 8 projected between the imaginary line R are all of the ejection holes 8 (16) belonging to one ejection hole column 9A and halves (8) of the ejection holes 8 belonging to the two ejection hole columns 9A positioned at the two sides of that ejection hole column 9A. In order to form such configuration, in each ejection hole row 9B, the ejection holes 8 are aligned at intervals of 22.5 dpi. This is because 360/16 is equal to 22.5.

The first common channels 20 and the second common channels 24 form straight lines in a range where the ejection holes 8 are linearly aligned and are offset in parallel between the ejection holes 8 forming lines offset from the straight lines. In the first common channels 20 and second common channels 24, there are few such offset portions, therefore the channel resistances become small. Further, these parallel offset parts are arranged at positions that are not superimposed over the pressurizing chambers 10, therefore fluctuation of ejection characteristics can be made smaller for each of the pressurizing chambers 10.

One pressurizing chamber column 11A at each of the two ends of the first direction (that is, two columns in total) includes the usual pressurizing chambers 10 and dummy pressurizing chambers 10D (for this reason, this pressurizing chamber column 11A will be sometimes referred to as the "dummy pressurizing chamber column 11D"). Further, on the further outer side of the dummy pressurizing chamber column 11D, one dummy pressurizing chamber column 11D (that is, two columns in total on the two ends) having only dummy pressurizing chambers 10D aligned therein is arranged. Each channel located on each of the two ends of the first direction (that is two in total) has the same shape as that of a usual first common channel 20. However, it is not directly linked with the pressurizing chambers 10 and is linked with only the dummy pressurizing chambers 10D.

The first channel member 4 has end part channels 30 which are positioned at the outside of the common channel group configured by the first common channels 20 and second common channels 24 in the first direction and extend in the second direction. The end part channels 30 are channels which connect openings 30*c* arranged on the further outer sides of the openings 20*a* in the first common channels 20 aligned on the pressurizing chamber surface 4-1 and openings 30*d* arranged on the further outer sides of the openings 24*a* in the second common channels 24 aligned on the pressurizing chamber surface 4-1.

In order to stabilize the ejection characteristics of the liquid, the head body 2*a* is controlled so as to make the temperature constant. Further, the ejection and circulation of liquid are stabilized more as the viscosity of the liquid becomes lower. Therefore, the temperature is basically controlled to the normal temperature or more. For this reason, basically heating is carried out. However, where the environmental temperature is high, sometimes it is cooled.

In order to keep the temperature constant, a liquid ejection head 2 is sometimes provided with a heater. Further, sometimes temperature-adjusted liquid is supplied to the liquid ejection head 2. In any case, when there is a difference between the environmental temperature and the target temperature, a greater amount of heat is radiated from the end parts of the head body 2*a* in the longitudinal direction (first direction and fourth direction), therefore the temperatures of the pressurizing chambers 10 positioned at the ends in the first direction and fourth direction are apt to become lower relative to the temperature of the liquid in the pressurizing chambers 10 positioned in the central part in the longitudinal direction. By provision of the end part channels 30, the temperatures of the pressurizing chambers 10 positioned at the ends in the first direction and fourth direction become harder to fall, therefore the variation in ejection characteristics of the liquid ejected from the pressurizing chambers 10 can be made smaller, so the printing precision can be improved.

The end part channels 30 are the channels which link a first integrating channel 22 and a second integrating channel 26. The channel resistances of the end part channels 30 are preferably smaller than the channel resistances of the first common channels 20 and second common channels 24. By doing this, the amounts of liquid flowing in the end part channels 30 becomes larger, therefore a temperature drop on the inner side from the end part channels 30 can be suppressed more.

The end part channels 30 are provided with wide portions 30*a* in which the widths of the channels are broader than the widths of the common channels. Dampers are provided on the pressurizing chamber surface 4-1 sides of the wide portions 30*a*. In each damper, a first surface faces the wide portion 30*a*, and a second surface positioned on the opposite side to the first surface faces the damper chamber, so it becomes deformable. The damping capability of the damper is largely influenced by the portion having the narrowest span in the deformable region. For this reason, by providing the damper so as to face the wide portion 30*a*, a damper having a high damping capability can be formed. The width of the wide portion 30*a* is preferably 2 times or more, particularly preferably 3 times or more, of the width of the common channels. If the channel resistance becomes too low due to providing the wide portion 30*a*, a narrowed portion 30*b* may be provided to adjust the channel resistance as well.

The second channel member 6 is joined to the pressurizing chamber surface 4-1 of the first channel member 4. The second channel member 6 has the first integrating channel 22 supplying liquid to the first common channels 20 and the second integrating channel 26 collecting the liquid in the second common channels 24. Each of the first integrating channel 22 and the second integrating channel 26 extends in the first direction. The thickness of the second channel member 6 is thicker than the first channel member 4 and is about 5 to 30 mm. Note that, the first integrating channel 22 and the second integrating channel 26 will be sometimes referred to as the "integrating channels" together.

The second channel member 6 is joined in a region of the pressurizing chamber surface 4-1 of the first channel member 4 where the piezoelectric actuator substrate 40 is not connected. More specifically, it is joined so as to surround the piezoelectric actuator substrate 40. By doing this, deposition of a portion of the ejected liquid as mist onto the piezoelectric actuator substrate 40 can be suppressed. Further, it means fixing the first channel member 4 on the periphery, therefore vibration of the first channel member 4 along with driving of the displacement elements 50 to cause resonation and so on can be suppressed.

Further, a through hole 6*c* vertically penetrates through the center part of the second channel member 6. In the through hole 6*c*, a circuit member such as an FPC (flexible printed circuit) transmitting a driving signal for driving the piezoelectric actuator substrate 40 is passed. Note that, the first channel member 4 side in the through hole 6*c* becomes a widened part 6*ca* having a broad width in the transverse direction. The circuit member which extends from the piezoelectric actuator substrate 40 to the two sides of the transverse direction is bent in the widened part 6*ca* and heads upward, then passes through the through hole 6*c*. Note that, the projecting portion expanding toward the widened part 6*ca* is liable to damage the circuit member, therefore may be formed rounded.

By arranging the first integrating channel 22 in the second channel member 6 separate from the first channel member 4 and thicker than the first channel member 4, the cross-sectional area of the first integrating channel 22 can be made larger. Due to that, the difference of pressure loss due to the difference in positions where the first integrating channel 22 and the first common channels 20 are linked can be made smaller. The channel resistance of the first integrating channel 22 (more correctly, the channel resistance in a range of the first integrating channel 22 linked with the first common channels 20) is preferably controlled to 1/100 or less of the first common channels 20.

By arranging the second integrating channel 26 in the second channel member 6 separate from the first channel member 4 and thicker than the first channel member 4, the cross-sectional area of the second integrating channel 26 can be made larger. Due to that, the difference of pressure loss due to the difference in positions where the second integrating channel 26 and the second common channels 24 are linked can be made smaller. The channel resistance of the second integrating channel 26 (more correctly, the channel resistance of a range of the second integrating channel 26 linked with the first integrating channels 22) is preferably controlled to 1/100 or less of the second common channels 24.

The first integrating channel 22 is arranged at the first end of the second channel member 6 in the transverse direction, while the second integrating channel 26 is arranged at the second end of the second channel member 6 in the transverse direction. Further, the channels are arranged so that they face the first channel member 4. These channels are linked with the first common channels 20 and the second common channels 24 in the structure. By doing this, the cross-sectional areas of the first integrating channel 22 and the second integrating channel 26 can be made larger (that is, the channel resistances can be made smaller), the periphery of the first channel member 4 is fixed by the second channel member 6 to raise the rigidity, and further the through hole 6*c* through which the circuit member passes can be provided.

The second channel member 6 is configured by stacking plates 6*a* and 6*b* of the second channel member. A first groove and second groove are formed in the upper surface of the plate 6*b*. The first groove is a groove which becomes the first integrating channel body 22*a*. The first integrated channel body 22*a* is a portion of the first integrating channel 22 which extends in the first direction and has a low channel resistance. The second groove is a groove which becomes the second integrated channel body 26*a*. The second integrated channel body 26*a* is a portion of the second integrating channel 26 which extends in the first direction and has a low channel resistance.

Most of the lower side (the direction of the first channel member 4) of the first groove which becomes the integrated channel body 22*a* is closed by the pressurizing chamber surface 4-1. A portion is linked with the openings 20*a* in the first common channels 20 opened on the pressurizing chamber surface 4-1.

Most of the lower side of the second groove which becomes the second integrated channel body 26*a* is closed by the pressurizing chamber surface 4-1. A portion is linked with the openings 24*a* in the second common channels 24 opened on the pressurizing chamber surface 4-1.

In the plate 6*a*, an opening 22*c* is provided at the end part of the first integrating channel 22 in the first direction. In the plate 6*a*, an opening 26*c* is provided in the end part of the second integrating channel 26 in the fourth direction of the opposite direction to the first direction. The liquid is supplied to the opening 22*c* of the first integrating channel 22 and is collected from the opening 26*c* of the second integrating channel 26. However, the configuration is not limited to this. The supply and the collection may be reversed.

The first integrating channel 22 and the second integrating channel 26 may be provided with dampers so that the supply or discharge of the liquid becomes stable against fluctuation of the amount of ejection of the liquid as well. Further, by providing filters in the first integrating channel 22 and second integrating channel 26, foreign substances, air bubbles, etc. may be prevented from entering into the first channel member 4 as well.

To the pressurizing chamber surface 4-1 which is the top surface of the first channel member 4, the piezoelectric actuator substrate 40 including the displacement elements 50 is joined. The displacement elements 50 are arranged to be positioned on the pressurizing chambers 10. The piezoelectric actuator substrate 40 occupies a region having almost the same shape as that of the pressurizing chamber group formed by the pressurizing chambers 10. Further, the openings of the pressurizing chambers 10 are closed by the piezoelectric actuator substrate 40 being joined to the pressurizing chamber surface 4-1 of the first channel member 4. The piezoelectric actuator substrate 40 has a rectangular shape which is longer in the same direction as that of the head body 2*a*. Further, to the piezoelectric actuator substrate 40, an FPC or other signal transmission part for supplying signals to the displacement elements 50 is connected. In the second channel member 6, there is a vertically penetrating through hole 6*c* at the center. The signal transmission part passes through the through hole 6*c* and is electrically connected with the control part 88. If the signal transmission part is shaped so as to extend in the transverse direction from the end of the first long side toward the end of the second long side of the piezoelectric actuator substrate 40 so that the wirings arranged in the signal transmission part extend along the transverse direction and are aligned in the longitudinal direction, the distance between wirings can be more easily obtained.

At the positions on the upper surface of the piezoelectric actuator substrate 40 which face the pressurizing chambers 10, individual electrodes 44 are arranged.

The first channel member 4 has a multilayer structure obtained by stacking a plurality of plates. From the pressurizing chamber surface 4-1 side of the first channel member 4, 12 plates from the plate 4*a* to the plate 4*i* are stacked in order. In these plates, a large number of holes and grooves are formed. The holes and grooves can be formed by for example fabricating the plates by metal and etching them. The thickness of each plate is made about 10 to 300 μm, so the precision of formation of the holes and grooves formed can be raised. The plates are stacked and positioned so that these holes and grooves are communicated with each other and configure the first common channels 20 and other channels.

At the pressurizing chamber surface 4-1 of the plate shaped first channel member 4, pressurizing chamber bodies 10*a* are opened. The piezoelectric actuator substrate 40 is joined to this surface. Further, at the pressurizing chamber surface 4-1, openings 20*a* for supplying liquid to the first common channels 20 and openings 24*a* collecting the liquid from the second common channels 24 are formed. At the surface of the first channel member 4 at the opposite side to the pressurizing chamber surface 4-1, that is, at the ejection hole surface 4-2, ejection holes 8 are opened. Note that, a plate may be further stacked on the pressurizing chamber surface 4-1 to close the openings of the pressurizing chamber bodies 10*a*, then the piezoelectric actuator substrate 40 joined to the top thereof. By doing this, the possibility of the ejected liquid contacting the piezoelectric actuator substrate 40 can be reduced, and the reliability can be made higher.

A structure for ejecting liquid includes a pressurizing chamber 10 and ejection hole 8. The pressurizing chamber 10 is configured by a pressurizing chamber body 10*a* facing a displacement element 50 and a descender 10*b* having a smaller cross-sectional area than the pressurizing chamber body 10*a*. The pressurizing chamber body 10*a* is formed in the plate 4*a*. The descender 10*b* is configured by holes formed in the plates 4*b* to 4*k* superimposed on each other and further closed by the plate 4*l* (at a portion other than the ejection hole 8).

The pressurizing chamber body 10*a* is linked with a first individual channel 12. The first individual channel 12 is linked with a first common channel 20. The first individual channel 12 includes a circular hole penetrating through the plate 4*b*, a through groove which extends in the surface direction in the plate 4*c*, and a circular hole penetrating through the plate 4*d*. The first common channel 20 is formed by holes formed in the plates 4*f* to 4*i* and superimposed on each other and further closed on the upper side by the plate 4*e* and closed on the lower side by the plate 4*j*.

The descender 10*b* is linked with a second individual channel 14. The second individual channel 14 is linked with a second common channel 24. The second individual channel 14 is a through groove extending in the surface direction in the plate 4*j*. The second common channel 24 is formed by holes formed in the plates 4*f* to 4*i* and superimposed on each other and further closed on the upper side by the plate 4*e* and closed on the lower side by the plate 4*j*.

Summarizing the flow of the liquid, the liquid supplied to a first integrating channel 22 passes through a first common channel 20 and first individual channel 12 in order and enters into a pressurizing chamber 10, then part of the liquid is ejected from an ejection hole 8. The liquid which is not ejected passes through a second individual channel 14, second common channel 24, and second integrating channel 26 in order and is discharged to the outside of the head body 2*a*.

Note that, the present embodiment shows an example of a liquid ejection head having a liquid circulation function. However, the second individual channels 14, second common channels 24, second integrating channel 26, first connection channels 25A, and second connection channels 25B need not be provided. That is, the liquid ejection head does not have to have a liquid circulation function.

The piezoelectric actuator substrate 40 has a multilayer structure comprised of two piezoelectric ceramic layers 40*a* and 40*b* which are piezoelectric members. Each of these piezoelectric ceramic layers 40*a* and 40*b* has a thickness of about 20 μm. That is, the thickness of the piezoelectric actuator substrate 40 from the upper surface of the piezoelectric ceramic layer 40*a* to the lower surface of the piezoelectric ceramic layer 40*b* is about 40 μm. The ratio of thicknesses of the piezoelectric ceramic layer 40*a* and the piezoelectric ceramic layer 40*b* is controlled to 3:7 to 7:3, preferably 4:6 to 6:4. Both the piezoelectric ceramic layers 40*a* and 40*b* extend so as to be straddle a plurality of pressurizing chambers 10. These piezoelectric ceramic layers 40*a* and 40*b* are made of for example lead zirconate titanate (PZT)-based, $NaNbO_3$-based, $BaTiO_3$-based, $(BiNa)NbO_3$-based, $BiNaNb_5O_{15}$-based, or other ceramic material having ferroelectricity.

The piezoelectric actuator substrate 40 has a common electrode 42 made of Ag—Pd or other metal material and individual electrodes 44 made of Au or other metal material. The thickness of the common electrode 42 is about 2 μm, and the thicknesses of the individual electrodes 44 are about 1 μm.

The individual electrodes 44 are individually arranged on the upper surface of the piezoelectric actuator substrate 40 at positions facing the pressurizing chambers 10. Each individual electrode 44 includes an individual electrode body 44*a* which is smaller in planar shape than a pressurizing chamber body 10*a* by one size and has a substantially similar shape to the pressurizing chamber body 10*a*, and a lead out electrode 44*b* which is led out from the individual electrode body 44*a*. In the portion on one end of the lead out electrode 44*b* which is led out to the outside of the region facing the pressurizing chamber 10, a connection electrode 46 is formed. The connection electrode 46 is for example formed by a conductive resin containing for example silver particles or other conductive particles to a thickness of about 5 to 200 μm. Further, the connection electrode 46 is electrically joined with an electrode provided in a signal transmission part.

Further, on the upper surface of the piezoelectric actuator substrate 40, a common electrode-use surface electrode (not shown) is formed. The common electrode-use surface electrode and the common electrode 42 are electrically connected through a not shown through conductor provided in the piezoelectric ceramic layer 40*a*.

Details will be explained later, but the individual electrodes 44 are supplied with driving signals from the control part 88 through the signal transmission part. The driving signals are supplied at constant cycles synchronized with to the conveying speed of the printing paper P.

The common electrode 42 is formed in the region between the piezoelectric ceramic layer 40*a* and the piezoelectric ceramic layer 40*b* over almost the entire surface in the surface direction. That is, the common electrode 42 extends so as to cover all pressurizing chambers 10 in the region facing the piezoelectric actuator substrate 40. The common electrode 42 is linked with the common electrode-use surface electrode which is formed on the piezoelectric ceramic layer 40*a* at a position avoiding the group of electrodes configured by the individual electrodes 44 through a via hole formed penetrating through the piezoelectric ceramic layer 40*a*, is grounded, and is held at the ground potential. The common electrode-use surface electrode is directly or indirectly connected to the control part 88 in the same way as the plurality of individual electrodes 44.

A part of the piezoelectric ceramic layer 40*a* which is sandwiched between an individual electrode 44 and the common electrode 42 is polarized in the thickness direction and forms a displacement element 50 of a unimorph structure which displaces when voltage is applied to the individual electrode 44. More specifically, when giving the individual electrode 44 a potential different from that for the common electrode 42 and applying an electric field to the piezoelectric ceramic layer 40*a* in its polarization direction, that portion to which the electric field is applied acts as an active portion which is distorted by the piezoelectric effect. In this configuration, when an individual electrode 44 is made a predetermined positive or negative potential relative to the common electrode 42 by the control part 88 so that the electric field and the polarization become the same direction, the portion (active portion) sandwiched by the electrodes in the piezoelectric ceramic layer 40*a* contracts in the surface direction. On the other hand, the non-active layer of the piezoelectric ceramic layer 40*b* is not influenced by the electric field, therefore does not spontaneously contract and acts to restrict the deformation of the active portion. As a result, a difference arises in the strain in the polarization direction between the piezoelectric ceramic layer 40*a* and the piezoelectric ceramic layer 40*b*, therefore the piezoelectric ceramic layer 40*b* deforms (unimorph deformation) so as to project to the pressurizing chamber 10 side.

Next, the ejection operation of liquid will be explained. Under the control from the control part 88, a displacement element 50 is driven (displaced) according to the driving signals supplied to the individual electrode 44 through the driver IC etc. In the present embodiment, the liquid can be ejected by various driving signals. Here, however, so-called pull-push driving will be explained.

An individual electrode 44 is made a potential higher than the common electrode 42 (below, referred to as a "high potential") in advance. Whenever there is an ejection request, the individual electrode 44 is once made the same potential as the common electrode 42 (below, referred to as a "low potential") and, after that, is again made the high potential at a predetermined timing. Due to this, at the timing when the individual electrode 44 becomes the low potential, the piezoelectric ceramic layers 40*a* and 40*b* (begin to) return to their original (flat) shapes, therefore the capacity of the pressurizing chamber 10 increases compared with the initial state (state where the potentials of the two electrodes are different). Due to this, a negative pressure is given to the liquid in the pressurizing chamber 10. This being so, the liquid in the pressurizing chamber 10 begins to vibrate by a natural vibration period.

Specifically, first, the volume of the pressurizing chamber 10 begins to increases and the negative pressure gradually becomes smaller. Next, the volume of the pressurizing chamber 10 becomes the maximum, and the pressure becomes substantially zero. Next, the volume of the pressurizing chamber 10 begins to decrease, and the pressure becomes higher. After that, at the timing when the pressure becomes substantially maximum, the individual electrode 44 is made the high potential. This being so, the vibration applied first and the vibration applied next overlap, therefore a larger pressure is applied to the liquid. This pressure is propagated through the descender 10*b* and makes the liquid be ejected from the ejection hole 8.

That is, using a high potential as a standard, by supplying a driving signal of a pulse making a low potential for a constant period to an individual electrode 44, a droplet can be ejected. If this pulse width is a time of half of the natural vibration period of the liquid in the pressurizing chamber 10, that is, the AL (acoustic length), in principle, the ejection speed and ejection amount of the liquid can be made the maximum. The natural vibration period of the liquid in the pressurizing chamber 10 is greatly influenced by the physical properties of the liquid and the shape of the pressurizing chamber 10. Other than these, it is also influenced by the physical properties of the piezoelectric actuator substrate 40 and characteristics of the channels linked with the pressurizing chamber 10.

Figure 7:
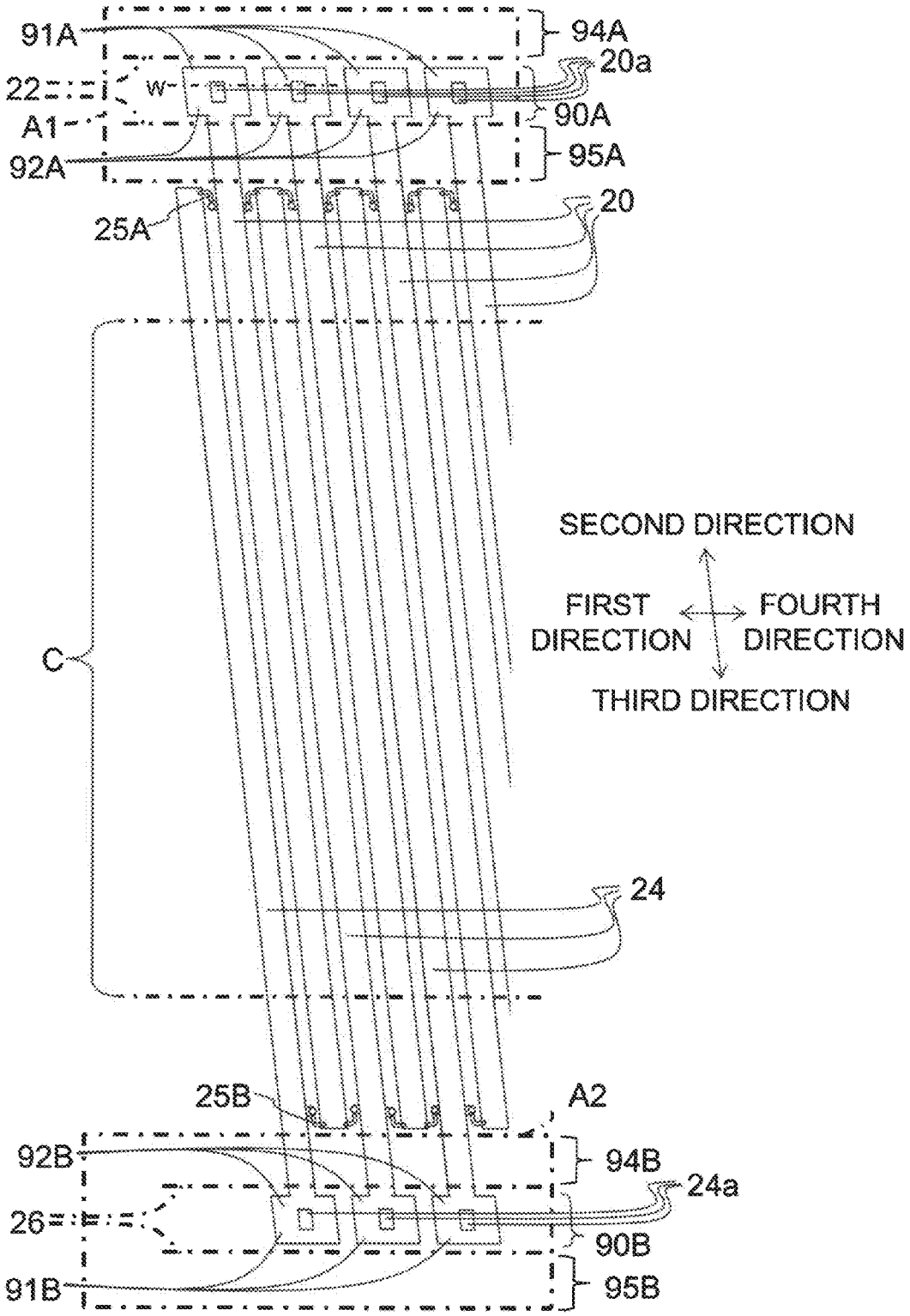
FIG. 7 An enlarged plan view showing common channels and joining regions in the head body.
Figure 8:
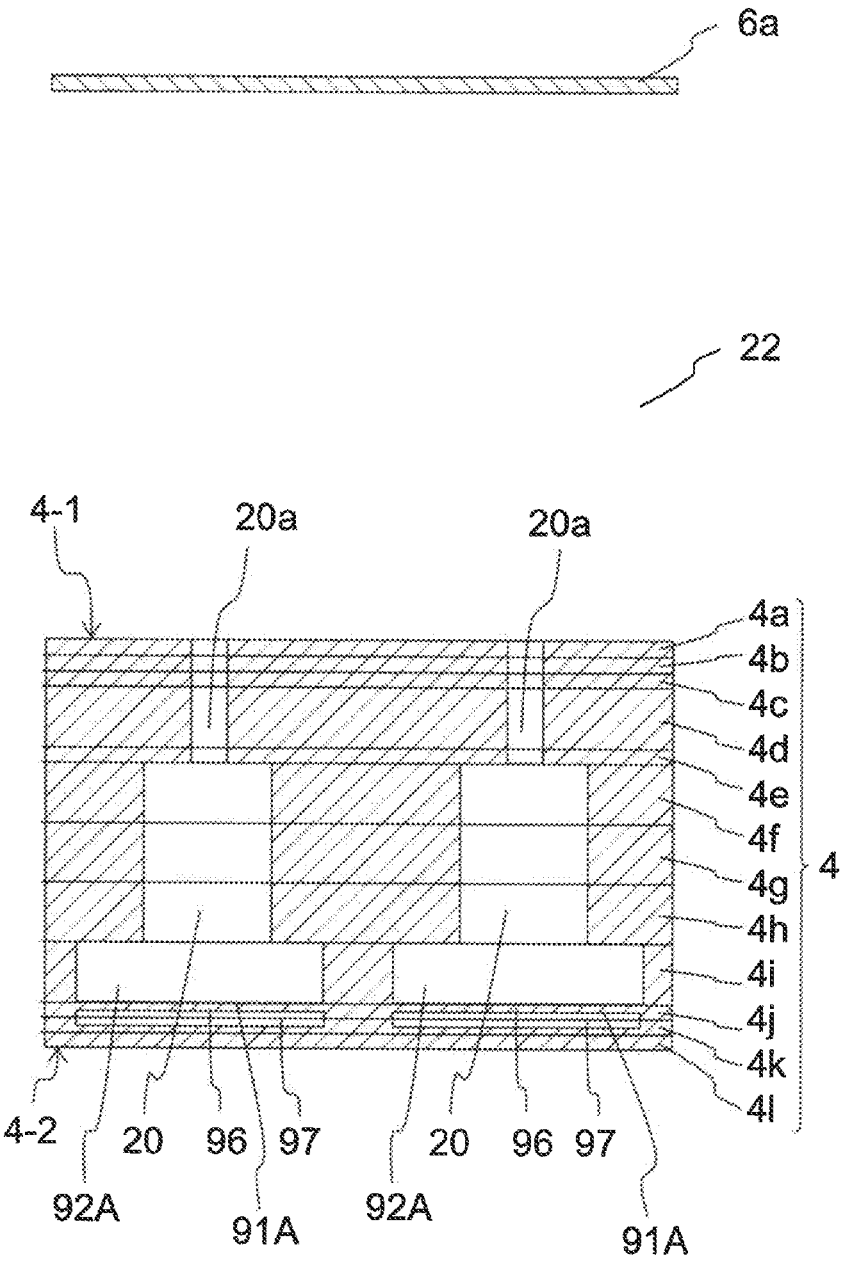
FIG. 8 A partial vertical cross-sectional view along the line W in FIG. 7.

The first common channels 20, second common channels 24, connection channels, etc. in the present embodiment will be explained by using FIG. 7 and FIG. 8. FIG. 7 is an enlarged plan view showing common channels and joining regions in a head body 2*a*. FIG. 8 is partial vertical cross-sectional view along the W line in FIG. 7. Note that, the first connection regions C shown in FIG. 7 are general ranges. The first connection region C of the first common channels 20 and the first connection region C of the second common channels 24 are offset a little in positions in the second direction. The first connection region C of the first common channels 20 is the range in the first common channels 20 from the first individual channels 12 linked to the endmost parts in the second direction up to the first individual channels 12 linked to the endmost parts in the third direction. The first connection region C of the second common channel 24 is the range in the second common channels 24 from the second individual channels 14 linked to the endmost parts in the second direction up to the second individual channels 14 linked to the endmost parts in the third direction.

In the first connection region C located at the center in the second direction of the first common channels 20 extending in the second direction, the first common channels 20 are linked through the first individual channels 12 with the pressurizing chambers 10. The first common channels 20 extend in the second direction even outside of the first connection region C in the second direction and open to the outside as the openings 20*a* at the end part of the first channel member 4 in the second direction.

In the first connection region C located at the center in the second direction of the second common channels 24 extending in the second direction, the second common channels 24 are linked through the second individual channels 14 with the pressurizing chambers 10. The second common channels 24 extend in the third direction even outside of the first connection region C in the third direction (opposite direction to the second direction) and open to the outside as the openings 24*a* at the end part of the first channel member 4 in the third direction.

The first channel member 4 and the second channel member 6 are joined at a first joining region A1 extending in the first direction in the end part of the first channel member 4 in the second direction and at a second joining region A2 extending in the first direction in the end part of the first channel member 4 in the third direction. Note that, the first channel member 4 and the second channel member 6 are joined at the same way at the end part in the first direction and at the end part in the fourth direction.

The first joining region A1 and the second joining region A2 are arranged spaced apart in the second direction. Between the first joining region A1 and the second joining region A2, the piezoelectric actuator substrate 40 is arranged on the pressurizing chamber surface 4-1 of the first channel member 4. To the displacement elements 50 arranged on the piezoelectric actuator substrate 40, driving signals are transmitted from the signal transmission part. Since the first joining region A1 and the second joining region A2 are arranged with a space therebetween, the displacement elements 50 and the signal transmission part can be electrically connected in the region between them.

The openings 20*a* in the first common channels 20 are arranged in the first joining region A1 and are linked with the first integrating channel 22 of the second channel member 6. The opening on the first channel member 4 side in the first groove which becomes the first integrating channel 22 extends in the first direction. The first integrating channel 22 is configured by closing the opening of the first groove on the first channel member 4 side by the first channel member 4. For this reason, the cross-sectional area of the cross-section of the first integrating channel 22 which is perpendicular to the first direction can be made larger with respect to the cross-sectional area of the cross-section of a portion of the second channel member 6 perpendicular to the first direction in which the first integrating channel 22 is arranged. Due to this, the channel resistance of the first integrating channel 22 can be made lower, therefore the pressure difference of the meniscus can be made smaller.

The openings 24*a* in the second common channels 24 are arranged in the second joining region A2 and are linked with the second integrating channel 26 of the second channel member 6. The opening on the first channel member 4 side in the second groove which becomes the second integrating channel 26 extends in the first direction. The second integrating channel 26 is configured by closing the opening of the second groove on the first channel member 4 side by the first channel member 4. For this reason, the cross-sectional area of the cross-section of the second integrating channel 26 which is perpendicular to the first direction can be made larger with respect to the cross-sectional area of the cross-section of the portion of the second channel member 6 perpendicular to the first direction in which the second integrating channel 26 is arranged. Due to this, the channel resistance of the second integrating channel 26 can be made lower, therefore the pressure difference of the meniscus can be made smaller.

The first common channels 20 extend in the third direction also at the outside of the first connection region C in the third direction, but end at positions where they do not reach the second joining region A2. Further, the first common channels 20 are linked through the second connection channel 25B with the second common channels 24 at the outside of the first connection region C in the third direction. Due to this, compared with the case where the first common channels 20 extend in the third direction until they are superimposed over the second joining region A2, the first channel member 4 becomes more solid.

Due to this, the rigidity of the first channel member 4 becomes higher, therefore the joining in the second joining region A2 can be made stronger. This is particularly effective in a case where the rigidity of the second joining region A2 of the second channel member 6 becomes relatively low due to the second integrating channel 26 being configured by closing the opening of the second groove at the first channel member 4 side by the first channel member 4. Further, if the rigidity of the first channel member 4 becomes higher, vibration of the first channel member 4 due to the influence of ejection etc. and that vibration affecting the ejection can be suppressed.

The second common channels 24 extend in the second direction also at the outside of the first connection region C in the second direction, but end at positions where they do not reach the first joining region A1. Further, the second common channels 24 are linked through the first connection channel 25A with the first common channels 20 at the outside of the first connection region C in the second direction. Due to this, compared with a case where the second common channels 24 extend to the second direction until they are superimposed over the first joining region A1, the first channel member 4 becomes more solid. Due to this, the joining in the first joining region A1 becomes stronger, and the rigidity of the first channel member 4 can be made higher.

Due to this, the rigidity of the first channel member 4 becomes higher and the joining in the first joining region A1 can be made stronger. This is particularly effective in a case where the rigidity of the first joining region A1 of the second channel member 6 becomes relatively low because of the first integrating channel 22 being configured by closing the opening of the first groove at the first channel member 4 side by the first channel member 4. Further, if the rigidity of the first channel member 4 becomes higher, vibration of the first channel member 4 due to the influence of ejection etc. and that vibration affecting the ejection can be suppressed.

Note that, in the present embodiment, both of the first joining region A1 and the second joining region A2 form the state explained above, but just one may be made the state explained above as well.

Further, as shown in FIG. 7 and FIG. 8, in the present embodiment, each first common channel 20 has a region connected to the first integrating channel 22, constituting a second connection region 90A, at a location separated from the first connection region C in the second direction. Further, the opening 20*a* linked with the first integrating channel 22 is arranged at the inner wall at the second connection region 90A of each first common channel 20. A damper 91A is arranged at the portion in the second connection region 90A of each first common channel 20 which faces the opening

20*a*. Each damper 91A is configured by a small thickness portion 96 which is a portion having a wall thinner than those of the other portions, and a damper chamber 97 which is a space arranged on the opposite side to the first common channel 20 sandwiching the small thickness portion 96 therebetween. Further, each first common channel 20, in the second connection region 90A, has a wide portion 92A in which the length in the first direction of the internal space is larger than those of the other portions. The damper 91A is arranged over the entire wide portion 92A.

Further, each second common channel 24 has a region connected to the second integrating channel 26, constituting a second connection region 90B, at a location separated from the first connection region C in the third direction. Further, the opening 24*a* linked with the second integrating channel 26 is arranged at the inner wall at the second connection region 90B of each second common channel 24. A damper 91B is arranged in the portion in the second connection region 90B of each second common channel 24 which faces the opening 24*a*. The cross-sectional structure of the second connection region 90B is the same as the cross-sectional structure of the second connection region 90A shown in FIG. 8. Each damper 91B is configured by a small thickness portion which is a portion having a wall thinner than those of the other portions, and a damper chamber which is a space arranged on the opposite side to the second common channel 24 sandwiching the small thickness portion therebetween. Further, each second common channel 24, in the second connection region 90B, has a wide portion 92B in which the length in the first direction of the internal space is larger than those of the other portions. The damper 91B is arranged over the entire wide portion 92B.

Note that, sometimes the second connection region 90A and the second connection region 90B will be referred to as the "second connection regions 90" together, the damper 91A and the damper 91B will be referred to as the "dampers 91" together, the wide portion 92A and the wide portion 92B will be referred to as the "wide portions 92" together, and the opening 20*a* and the opening 24*a* will be referred to as the "openings" together.

In this way, in the present embodiment, in the second connection regions 90 of the common channels, the dampers 91 are arranged at portions facing the openings linked with the integrating channels. Due to this, it can be reduced that the pressure fluctuation caused in the liquid in the integrating channels is transferred to the liquid in the ejection holes 8 through the common channels and individual channels to exert an adverse influence upon the ejection of the liquid. In the past, it has been known that the pressure fluctuation applied to the liquid in one pressurizing chamber 10 passes through the individual channel linked with the pressurizing chamber 10, the common channel linked to that, and then through the other individual channel linked to that and then is transferred to the liquid in an ejection hole 8 linked with another pressurizing chamber 10, and exerts adverse influence upon the ejection of the liquid. However, separately from that, the inventor found that pressure fluctuation was caused in the liquid in an integrating channel by a certain cause and that pressure fluctuation was transferred through the common channel and individual channel to an ejection hole 8 to exert an adverse influence upon the ejection of the liquid. Further, the inventors confirmed by various studies that the improvement is achieved with respect to this problem according to the configuration as explained above. Note that, the cause of generation of pressure fluctuation in the liquid in the integrating channel has not yet been clarified, but various causes are postulated. The various causes are for example transfer of the pressure fluctuation applied to the liquid in the pressurizing chamber 10 connected to another common channel to the liquid in the integrating channel and transfer of the pressure fluctuation caused by a pump for circulating the liquid in the liquid ejection head 2 to the liquid in the integrating channel.

Further, in the present embodiment, each common channel, in the second connection region, has the wide portion 92 in which the length in the first direction of the internal space is larger than those of the other portions. The damper 91 is provided at the wide portion 92, and the length in the first direction of the damper 91 is larger than the length in the first direction in the portions other than the wide portion 92 in the common channel. Due to this, the damper 91 having a high damping capability can be formed.

Further, in the present embodiment, as shown in FIG. 8, in each first common channel 20, the length in the first direction of the space for accommodating the liquid becomes larger stepwise from the opening 20*a* toward the damper 91A. Although it is not shown, the same is true for the second common channel 24. From the opening 24*a* toward the damper 91B, the length in the first direction of the space for accommodating the liquid becomes larger stepwise. In this way, in each common channel, the length in the first direction of the space for accommodating the liquid becomes larger stepwise from the opening toward the damper 91. Due to this, the influence of the pressure fluctuation transferred through the opening from the common channel is made smaller, and the damping effect by the damper 91 can be raised.

Further, in the present embodiment, the damper 91 is provided isolated from the first damper 28A arranged in the first connection region C. Due to this, it is possible to reduce the fact that the transfer of the pressure fluctuation to the liquid in the ejection hole 8 comes easier to occur because of the damper 91 vibrating due to pressure fluctuation transferred from the integrating channel, and that vibration is directly transferred to the first damper 28A in the first connection region C.

Further, in the present embodiment, as shown in FIG. 7, the first joining region A1 has a region in which the first integrating channel 22 is arranged, a first region 94A, and a second region 95A. The first region 94A is the region positioned on the second direction side relative to the region in which the first integrating channel 22 is arranged. The second region 95A is the region positioned on the third direction side of the opposite direction to the second direction relative to the region in which the first integrating channel 22 is arranged. The first region 94A is positioned more on the second direction side than the region in which the wide portion 92A of the first common channel 20 is arranged, and the second region 95A is positioned more on the third direction side than the region in which the wide portion 92A of the first common channel 20 is arranged.

Further, the second joining region A2 has a region in which the second integrating channel 26 is arranged, a first region 94B, and a second region 95B. The first region 94B is the region positioned on the second direction side relative to the region in which the second integrating channel 26 is arranged. The second region 95B is the region positioned on the third direction side of the opposite direction to the second direction relative to the region in which the second integrating channel 26 is arranged. The first region 94B is positioned more on the second direction side than the region in which the wide portion 92B of the second common channel 24 is arranged, and the second region 95B is positioned more on the third direction side than the region in which the wide portion 92B of the second common channel 24 is arranged.

Note that, sometimes the first joining region A1 and the second joining region A2 will be referred to as the "joining regions A" together, the first region 94A and the first region 94B will be referred to as the "first regions 94" together, and the second region 95A and the second region 95B will be referred to as the "second regions 95" together.

In this way, the joining regions A have regions where the integrating channels are arranged, the first regions 94 positioned on the second direction side relative to the regions where the integrating channels are arranged, and the second regions 95 positioned on the third direction side of the opposite direction to the second direction relative to the regions where the integrating channels are arranged. The first regions 94 are positioned more on the second direction side than the regions where the wide portions 92 of the common channels are arranged, and the second regions 95 are positioned more on the third direction side than the regions where the wide portions 92 of the common channels are arranged. Due to this, for example, when bonding the first channel member 4 and the second channel member 6, it becomes possible to apply a strong pressure to the first regions 94 and second regions 95, therefore the bonding strength between the first channel member 4 and the second channel member 6 can be raised.

Second Embodiment

Figure 9:
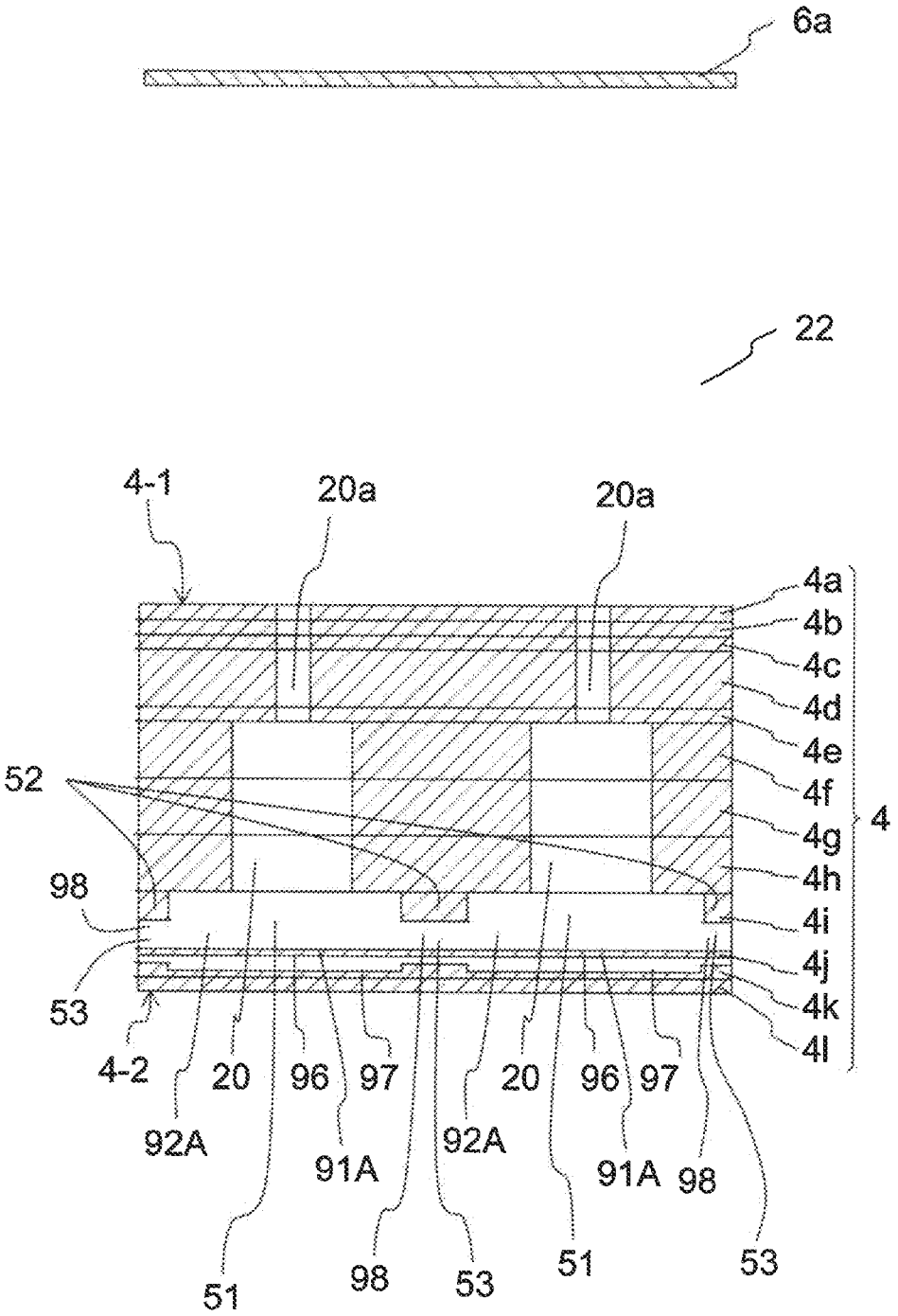
FIG. 9 A partial cross-sectional view the same as FIG. 8 showing a head body in a second embodiment of the present invention.

FIG. 9 is a partial cross-sectional view of the same place as in FIG. 8 for the head body 2*a* in the second embodiment of the present invention. Note that, in the present embodiment, an explanation will be given on only points different from the first embodiment explained before. The same components will be assigned the same notations and overlapping explanations will be omitted. Further, FIG. 9 shows the cross-sectional structure in the second connection region 90A, but the cross-sectional structure in the second connection region 90B is the same.

In the present embodiment, as shown in FIG. 9, damper chambers 97 in the first common channels 20 adjoining each other in the first direction are connected. Due to this, the volumes of the damper chambers 97 can be made larger, therefore it is possible to keep the air closed in the damper chambers 97 from acting as springs and hindering the motion of the small thickness portion 96 resulting in a drop in the damping effect.

Further, the head body 2*a* in the present embodiment has a plurality of end part connection channels 98. The first common channels 20 adjoining each other in the first direction are connected and linked by the end part connection channels 98 in the second connection region 90A. Due to this, the areas of the dampers 91A can be increased, therefore the damping effect by the dampers 91A can be further raised.

Further, in the present embodiment, the small thickness portions 96 in the first common channels 20 adjoining each other in the first direction are connected to each other to form integral parts. Due to this, the small thickness portions 96 become further easier to move, therefore the damping effect by the dampers 91A can be further raised.

Further, in the present embodiment, the cross-sectional areas of the end part connection channels 98 become much smaller than the cross-sectional areas of the other portions of the first common channels 20, therefore the channel resistances per unit length of the end part connection channels 98 become larger than the channel resistances per unit length of the first common channels 20. Due to this, the transfer of the pressure fluctuation generated in the liquid in one first common channel 20 to the liquid in another first common channel 20 through the end part connection channels 98 can be reduced.

Further, in the present embodiment, the first common channels 20 and end part connection channels 98 are configured by stacking a plurality of flat plates (4*a* to 4*k*). The plate 4*j* in which the end part connection channels 98 are arranged has holes 51 which form the plurality of first common channels 20, partition portions 52 which form partition walls among the plurality of first common channels 20, and groove portions 53 which are provided in the portions which form the plurality of end part connection channels 98 and link the adjoining holes 51 to each other. Due to this, in the plate 4*j*, fall off of the portions surrounded by the holes 51 can be prevented. Therefore, a channel member which is easily manufactured can be obtained. Further, the groove portions 53 are formed in the surface on the small thickness portion 96 side (plate 4*j* side) in the plate 4*j* in which the end part connection channels 98 are arranged, therefore the movement of the small thickness portions 96 is not prevented, so dampers 91A having a high damping capability can be formed.

Note that, the present embodiment showed an example in which the end part connection channels 98 were configured by groove portions 53 provided in the plate 4*j*, but the present invention is not limited to this. For example, it is also possible to configure the end part connection channels 98 by through holes provided in the plate. Further, it is not limited to the method of stacking a plurality of channel members, for example, the channel members may be formed by another method such as a method using a 3D printer.

REFERENCE SIGNS LIST

1 . . . color inkjet printer
2 . . . liquid ejection head
  2*a* . . . head body
4 . . . first channel member (channel member)
  4*a* to 4*l* . . . plates (of first channel member)
  4-1 . . . pressurizing chamber surface
  4-2 . . . ejection hole surface
6 . . . second channel member
  6*a*, 6*b* . . . plates (of second channel member)
  6*c* . . . through hole (of second channel member)
  6*ca* . . . widened portion of through-hole
8 . . . ejection hole
9A . . . ejection hole column
9B . . . ejection hole row
10 . . . pressurizing chamber
  10*a* . . . pressurizing chamber body
  10*b* . . . partial channel (descender)
10D . . . dummy pressurizing chamber
11A . . . pressurizing chamber column
11B . . . pressurizing chamber row
11C . . . pressurizing chamber arrangement region
12 . . . first individual channel
14 . . . second individual channel
20 . . . first common channel (common channel)
  20*a* . . . opening (of first common channel)
22 . . . first integrating channel
  22*a* . . . first integrated channel body (first groove)
  22*c* . . . opening (of first integrating channel)
24 . . . second common channel (common channel)
  24*a* . . . opening (of second common channel)

25A, 125A . . . first connection channels
25B . . . second connection channel
26 . . . second integrating channel
26*a* . . . second integrated channel body (second groove)
26*c* . . . opening (of second integrating channel)
28A . . . first damper
28B . . . second damper
29 . . . damper chamber
30 . . . end part channel
30*a* . . . wide portion
30*b* . . . narrowed portion
30*c*, 30*d* . . . openings (of end part channels)
40 . . . piezoelectric actuator substrate
40*a* . . . piezoelectric ceramic layer
40*b* . . . piezoelectric ceramic layer (vibration plate)
42 . . . common electrode
44 . . . individual electrode
44*a* . . . individual electrode body
44*b* . . . lead out electrode
46 . . . connection electrode
50 . . . displacement element (pressurizing portion)
51 . . . hole
52 . . . partition portion
53 . . . groove portion
60 . . . signal transmission part
70 . . . head mounting frame
72 . . . head group
80A . . . paper feed roller
80B . . . collection roller
82A . . . guide roller
82B . . . conveying roller
88 . . . control part
90A, 90B . . . second connection regions
91A, 91B . . . dampers
92A, 92B . . . wide portions
94A, 94B . . . first regions
95A, 95B . . . second regions
96 . . . small thickness portion
97 . . . damper chamber
98 . . . end part connection channel
A1 . . . first joining region
A2 . . . second joining region
B1 . . . first extension region
B2 . . . first extension region
C . . . first connection region
P . . . printing paper

The invention claimed is:

1. A channel member comprising:

an integrating channel extending in a first direction that includes a plurality of openings spaced apart in the first direction at a distance, a plurality of common channels that are spaced apart in the first direction at the distance in accordance with the plurality of openings, wherein each of the plurality of common channels:

extends in a second direction that crosses the first direction, connects to a corresponding opening among the plurality of openings in the integrating channel, and includes a first connection region, and a second connection region connected to the corresponding opening, wherein the second connection region is separated from the first connection region in the second direction as a length direction;

a plurality of individual channels, wherein each of the plurality of individual channels:

connects to the first connection region of each of the plurality of common channels, each first connection region being connected with two or more the individual channels, includes a pressurizing chamber, and a plurality of dampers that are spaced apart in the first direction at the distance in accordance with the plurality of openings and are located in a portion in the second connection region, the portion facing the corresponding opening.

2. The channel member according to claim 1, wherein:

each of the plurality of common channels, in the second connection region, comprises a wide portion in which a length of an internal space thereof in the first direction is larger than those of other portions, and the plurality of dampers are disposed in the wide portion, and a length of the plurality of dampers in the first direction is larger than a length of a portion other than the wide portion in the first direction.

3. The channel member according to claim 2, wherein, in each of the plurality of common channels, the length of the internal space in the first direction becomes larger stepwise from the plurality of openings toward the damper.

4. The channel member according to claim 1, wherein each of the common channels is surrounded by a plurality of walls, and the plurality of dampers each include:

a thin portion having a wall thickness smaller than those of other portions, and a damper chamber which is a space located on an opposite side to a respective common channel sandwiching the thin portion therebetween, and wherein two damper chambers in neighboring two of the common channels spaced apart in the first direction are connected to each other.

5. The channel member according to claim 4, further comprising a plurality of end part connection channels, wherein two second connection regions in neighboring two of the common channels spaced apart in the first direction are in communication with each other through one of the end part connection channels.

6. The channel member according to claim 5, wherein a channel resistance of each of the plurality of end part connection channels is larger than a channel resistance of each of the plurality of common channels.

7. The channel member according to claim 5, wherein two of the thin portions in neighboring two of the common channels spaced apart in the first direction are integrally connected.

8. The channel member according to claim 5, wherein:

the common channels and the end part connection channels each comprises a plurality of flat plates in a multi-layered structure, and one of the plates comprising the end part connection channels comprises holes which form the plurality of common channels, partition portions which form partition walls among the plurality of common channels, and groove portions which form the plurality of end part connection channels and which connect neighboring two of the holes.

9. A liquid ejection head comprising:

the channel member according to claim 1;

a plurality of pressurizing chambers corresponding to the respective plurality of individual channels; and a plurality of pressurizing portions applying pressure to the plurality of pressurizing chambers.

10. A recording apparatus comprising:

the liquid ejection head according to claim 9;

a conveying portion conveying a recording medium with respect to the liquid ejection head; and a control part controlling the liquid ejection head.

11. A channel member comprising:

an integrating channel that extends in a first direction;

a plurality of common channels that each extending in a second direction that crosses the first direction, are spaced apart in the first direction at a distance; and are connected to the integrating channel;

a plurality of individual channels connected to the plurality of common channels, respectively; and a plurality of ejection holes each being in communication with one of the plurality of individual channels, wherein each of the plurality of common channels comprises:

a first connection region connected to the plurality of individual channels; and a second connection region connected to the integrating channel and separated from the first connection region in the second direction, wherein the second connection region includes:

an opening in communication with the integrating channel, a wide portion in which a length of an internal space thereof in the first direction is larger than those of other portions, and a damper facing the opening, wherein the damper is disposed in the wide portion, and a length of the damper in the first direction is larger than a length of a portion other than the wide portion in the first direction.

12. The channel member according to claim 11, further comprising:

a first channel member comprising the plurality of ejection holes, the plurality of individual channels, and the plurality of common channels;

a second channel member disposed on the first channel member and comprises the integrating channel; and a joining region comprising the second connection region of the plurality of common channels, separated in the second direction from the first connection region, wherein the joining region comprises a first region which is located on a second direction side relative to the integrating channel, and a second region which is located on a third direction side opposite to the second direction side with respect to the integrating channel, the first region is located on the second direction side relative to the wide portion, the second region is located on the third direction side relative to the wide portion, and the first channel member and the second channel member are joined in the first region and in the second region.

13. A channel member comprising:

an integrating channel extending in a first direction, a plurality of common channels that each extend in a second direction that crosses the first direction, are spaced apart in the first direction at a distance, and are connected to the integrating channel;

a plurality of walls that surround each of the plurality of common channels;

a plurality of individual channels connected to the plurality of common channels, respectively;

a plurality of ejection holes each that are in communication with one of the plurality of individual channels; and a plurality of end part connection channels, wherein two second connection regions in neighboring two of the common channels spaced apart in the first direction are in communication with each other through one of the end part connection channels, wherein each of the plurality of common channels includes:

a first connection region connected to the plurality of individual channels; and a second connection region connected to the integrating channel, separated from the first connection region in the second direction, and comprising:

an opening in communication with the integrating channel; and a damper that includes a thin portion having a wall thickness smaller than those of other portions, and a damper chamber which is a space located on an opposite side to a respective common channel sandwiching the thin portion therebetween;

wherein two damper chambers in neighboring two of the common channels spaced apart in the first direction are connected to each other.

* * * * *